US010569580B2

(12) United States Patent
Deguchi et al.

(10) Patent No.: US 10,569,580 B2
(45) Date of Patent: Feb. 25, 2020

(54) INK JET RECORDING APPARATUS AND INK JET RECORDING METHOD

(71) Applicant: CANON KABUSHIKI KAISHA, Tokyo (JP)

(72) Inventors: Kyosuke Deguchi, Yokohama (JP); Toru Yamane, Yokohama (JP); Atsushi Sakamoto, Yokohama (JP); Satoshi Masuda, Yokohama (JP); Yoshiyuki Honda, Yokohama (JP); Ryosuke Hirokawa, Kawasaki (JP); Akihiro Mouri, Fuchu (JP); Toru Ohnishi, Yokohama (JP); Noboru Toyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/100,476

(22) Filed: Aug. 10, 2018

(65) Prior Publication Data

US 2018/0345702 A1 Dec. 6, 2018

Related U.S. Application Data

(63) Continuation of application No. PCT/JP2017/005035, filed on Feb. 13, 2017.

(30) Foreign Application Priority Data

Feb. 15, 2016 (JP) ..... 2016-026417
May 26, 2016 (JP) ..... 2016-105080

(51) Int. Cl.
*B41J 29/17* (2006.01)
*B41J 2/005* (2006.01)
(Continued)

(52) U.S. Cl.
CPC ..... *B41J 29/17* (2013.01); *B41J 2/01* (2013.01); *B41J 29/38* (2013.01); *B41J 2/0057* (2013.01)

(58) Field of Classification Search
CPC ..... B41J 29/17; B41J 29/38; B41J 2/01; B41J 2/0057
See application file for complete search history.

(56) References Cited

U.S. PATENT DOCUMENTS 5,008,690 A 4/1991 Koizumi et al.
7,341,622 B2 3/2008 Takagi
(Continued)

FOREIGN PATENT DOCUMENTS

JP 2001-179959 A 7/2001
JP 2005-161610 A 6/2005
(Continued)

OTHER PUBLICATIONS

International Preliminary Report on Patentability dated Aug. 30, 2018, in International Application No. PCT/JP2017/005035.
(Continued)

*Primary Examiner* — Geoffrey S Mruk
(74) *Attorney, Agent, or Firm* — Venable LLP

(57) ABSTRACT

An ink jet recording apparatus including: an image forming unit that forms a first image containing a first liquid and a coloring material on a transfer body; and a liquid absorbing device including a liquid absorbing member having a porous body coming in contact with the first image to at least partially absorb the first liquid from the first image, and a cleaning member coming in contact with the porous body to clean the porous body wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2| \quad (1).$$

9 Claims, 4 Drawing Sheets

(51) Int. Cl.
*B41J 2/01* (2006.01)
*B41J 29/38* (2006.01)

(56) References Cited

U.S. PATENT DOCUMENTS

| | | | | |
|---|---|---|---|---|
| 7,419,257 | B2 | 9/2008 | Mouri et al. | |
| 7,494,213 | B2 | 2/2009 | Taniuchi et al. | |
| 7,845,760 | B2 | 12/2010 | Hirakawa | |
| 7,926,933 | B2 | 4/2011 | Taniuchi et al. | |
| 7,997,717 | B2 | 8/2011 | Taniuchi et al. | |
| 8,220,917 | B2 | 7/2012 | Taniuchi et al. | |
| 9,067,449 | B2 * | 6/2015 | Morita | B41M 5/035 |
| 9,193,142 | B1 | 11/2015 | Moorlag et al. | |
| 10,046,556 | B2 | 8/2018 | Soma et al. | |
| 10,137,690 | B2 | 11/2018 | Hirokawa et al. | |
| 2014/0168312 | A1 | 6/2014 | Mizes et al. | |
| 2017/0217216 | A1 | 8/2017 | Ohnishi et al. | |
| 2018/0304615 | A1 | 10/2018 | Soma et al. | |
| 2018/0311951 | A1 | 11/2018 | Sakamoto et al. | |
| 2018/0319179 | A1 | 11/2018 | Yamane et al. | |
| 2018/0326719 | A1 | 11/2018 | Masuda et al. | |
| 2018/0326755 | A1 | 11/2018 | Ohnishi et al. | |
| 2018/0326756 | A1 | 11/2018 | Hirokawa et al. | |
| 2019/0001710 | A1 | 1/2019 | Hirokawa et al. | |
| 2019/0009515 | A1 | 1/2019 | Deguchi et al. | |
| 2019/0009546 | A1 | 1/2019 | Sakamoto et al. | |
| 2019/0009549 | A1 | 1/2019 | Takada et al. | |
| 2019/0009550 | A1 | 1/2019 | Inoue et al. | |
| 2019/0009577 | A1 | 1/2019 | Hirokawa et al. | |
| 2019/0009578 | A1 | 1/2019 | Takeuchi et al. | |
| 2019/0009579 | A1 | 1/2019 | Inoue et al. | |
| 2019/0009589 | A1 | 1/2019 | Hirokawa et al. | |
| 2019/0009592 | A1 | 1/2019 | Okushima et al. | |
| 2019/0009594 | A1 | 1/2019 | Sakamoto et al. | |
| 2019/0016112 | A1 | 1/2019 | Tsushima et al. | |

FOREIGN PATENT DOCUMENTS

| | | | |
|---|---|---|---|
| JP | 2005-281523 | A | 10/2005 |
| JP | 2006-306080 | A | 11/2006 |
| JP | 2007-98730 | A | 4/2007 |
| JP | 2007-268975 | A | 10/2007 |
| JP | 2008-6816 | A | 1/2008 |
| JP | 2009-45851 | A | 3/2009 |
| JP | 2009-119723 | A | 6/2009 |
| JP | 2015-9517 | A | 1/2015 |
| JP | 2015-145117 | A | 8/2015 |

OTHER PUBLICATIONS

International Search Report and Written Opinion dated May 16, 2017, in International Application No. PCT/JP2017/005035.

* cited by examiner

INK JET RECORDING APPARATUS AND INK JET RECORDING METHOD

CROSS-REFERENCE TO RELATED APPLICATIONS

This application is a Continuation of International Patent Application No. PCT/JP2017/005035, filed Feb. 13, 2017, which claims the benefit of Japanese Patent Application No. 2016-026417, filed Feb. 15, 2016 and Japanese Patent Application No. 2016-105080, filed May 26, 2016, both of which are hereby incorporated by reference herein in their entirety.

BACKGROUND OF THE INVENTION

Field of the Invention

The present invention relates to an ink jet recording apparatus and an ink jet recording method.

Description of the Related Art

In an ink jet recording method, an image is formed by directly or indirectly applying a liquid composition (ink) containing a coloring material onto a recording medium such as paper. Here, sometimes, curl or cockling occurs due to excessive absorption of a liquid component in the ink by the recording medium.

Therefore, in order to rapidly remove the liquid component in ink, there is a method of drying a recording medium using a unit such as warm air or infrared rays or a method of forming an image on a transfer body, drying a liquid component contained in an image on the transfer body using heat energy, etc, and then transferring the image onto a recording medium such as paper.

Further, as a unit of removing a liquid component contained in an image on a transfer body, a method of contacting a porous body having a roller shape with an ink image to absorb and remove the liquid component from the ink image without using heat energy has been suggested (Japanese Patent Application Laid-Open No. 2009-45851 and Japanese Patent Application Laid-Open No. 2005-161610). In addition, a method of contacting a polymer absorber having a belt shape with an ink image to absorb and remove the liquid component from the ink image has been suggested (Japanese Patent Application Laid-Open No. 2001-179959).

Further, in the case of removing a liquid component from an image on a recording medium using a porous body, in order to suppress a coloring material in an image from being adhered to the porous body, an apparatus which regulates magnification relationships between surface roughness of the porous body and the recording medium, surface free energy, and a contact angle has been suggested (Japanese Patent Application Laid-Open No. 2006-306080). In addition, an apparatus which regulates a magnification relationship between surface free energy of a transfer body, ink, and a reaction liquid in order to prevent image disturbance has been suggested (Japanese Patent Application Laid-Open No. 2008-6816).

SUMMARY OF THE INVENTION

In technologies disclosed in Japanese Patent Application Laid-Open No. 2009-45851, Japanese Patent Application Laid-Open No. 2005-161610, Japanese Patent Application Laid-Open No. 2001-179959, Japanese Patent Application Laid-Open No. 2006-306080 and Japanese Patent Application Laid-Open No. 2008-6816 described above, when a liquid component is removed from an image by a porous body, coloring material adhesion to the porous body is not sufficiently suppressed. Further, in the case of repeatedly using the porous body, sometimes the coloring material adhered to the porous body is re-transferred to a transfer body. An object of the present invention is to provide an ink jet recording apparatus capable of simultaneously suppressing coloring material from being adhered to a porous body and being re-transferred to a transfer body.

An ink jet recording apparatus according to the present invention includes: an image forming unit that forms a first image containing a first liquid and a coloring material on a transfer body; and a liquid absorbing device including a liquid absorbing member having a porous body coming in contact with the first image to at least partially absorb the first liquid from the first image, and a cleaning member coming in contact with the porous body to clean the porous body wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2| \quad (1).$$

Furthermore, an ink jet recording apparatus according to the present invention includes:

an image forming unit that applies ink containing a first liquid and a coloring material to form a first image on a transfer body; and a liquid absorbing device including a liquid absorbing member having a porous body coming in contact with the first image to concentrate the ink constituting the first image, and a cleaning member coming in contact with the porous body to clean the porous body, wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2| \quad (1)$$

Furthermore, an ink jet recording method according to the present invention includes the steps of:

forming a first image containing a first liquid and a coloring material on a transfer body; contacting a porous body with the first image to at least partially absorb the first liquid from the first image; and contacting a cleaning member with the porous body to clean the porous body, wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2 \quad (1).$$

Furthermore, an ink jet recording method according to the present invention includes the steps of:

applying ink containing a first liquid and a coloring material to form a first image on a transfer body;

contacting a porous body with the first image to concentrate the ink constituting the first image; and contacting a cleaning member with the porous body to clean the porous body, wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2 \quad (1).$$

Further features of the present invention will become apparent from the following description of exemplary embodiments with reference to the attached drawings.

DESCRIPTION OF THE EMBODIMENTS

Figure 1:
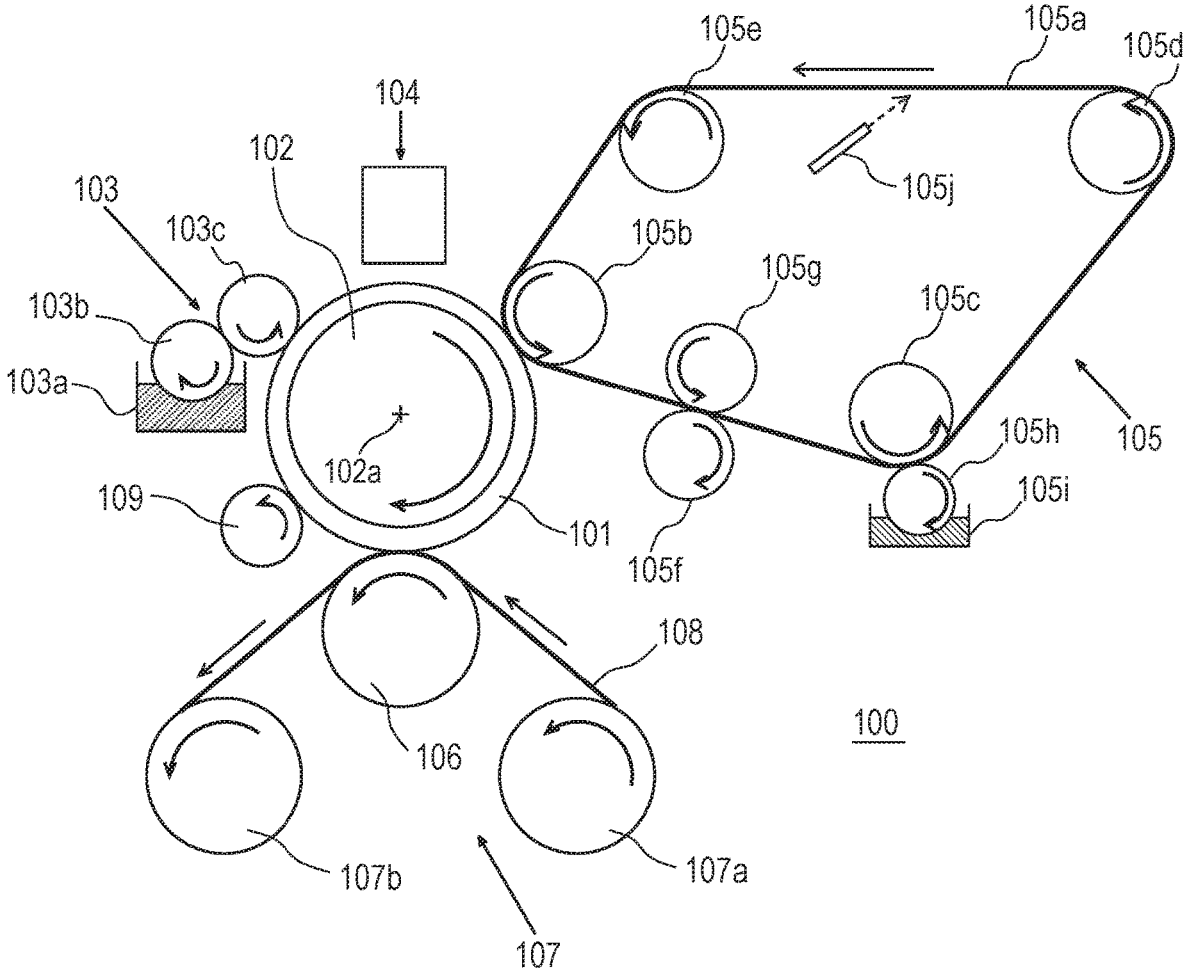
FIG. 1 is a schematic diagram illustrating an example of a configuration of an ink jet recording apparatus according to an exemplary embodiment of the present invention.

Hereinafter, the present invention is described in detail through preferable exemplary embodiments. An ink jet recording apparatus according to the present invention includes an image forming unit that forms a first image containing a first liquid and a coloring material on a transfer body. Further, the ink jet recording apparatus according to the present invention includes a liquid absorbing device including a liquid absorbing member having a porous body coming in contact with the first image to at least partially absorb the first liquid from the first image, and a cleaning member coming in contact with the porous body to clean the porous body.

In the ink jet recording apparatus according to the present invention, surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1).

$$|Y_d-Y_3|<|Y_d-Y_1|<|Y_d-Y_2| \quad (1)$$

The present inventors found that $Y_1$, $Y_2$, $Y_3$ and $Y_d$ satisfy Equation (1), such that adhesion with the first image is increased in a sequence of the porous body, the transfer body and the cleaning member (porous body<transfer body<cleaning member). Here, since adhesion of the transfer body with the first image is higher than that of the porous body, when the first liquid is at least partially absorbed from the first image by the porous body, adhesion of the first image containing the coloring material (hereinafter, also referred to as "coloring material adhesion") to the porous body is suppressed. Further, since adhesion of the cleaning member with the first image is higher than that of the porous body, even though the first image is partially adhered to the porous body as an adhered substance, the adhered substance can be removed by the cleaning member. In addition, since adhesion of the cleaning member with the adhered substance is higher than that of the transfer body, even in the case of repeatedly using the porous body, the adhered substance that is not removed by the cleaning member is not re-transferred to the transfer body. That is, re-transfer of the adhered substance adhered to the porous body to the transfer body (hereinafter, also referred to as "re-transfer") is suppressed.

An ink jet recording method according to the present invention includes the following steps: a step of forming a first image containing a first liquid and a coloring material on a transfer body; a step of contacting a porous body with the first image to at least partially absorb the first liquid from the first image; and a step of contacting a cleaning member with the porous body to clean the porous body.

In the ink jet recording method according to the present invention, surface free energy $Y_1$ of the transfer body, surface free energy $Y_2$ of the porous body, surface free energy $Y_3$ of the cleaning member, and a dispersion force component $Y_d$ of surface free energy of the first image satisfy Equation (1). Therefore, as described above, coloring material adhesion and re-transfer are suppressed. In the ink jet recording method according to the present invention, the ink jet recording apparatus according to the present invention can be preferably used.

[Image Forming Unit]

In the ink jet recording apparatus according to the present invention, the image forming unit is not particularly limited as long as it can form the first image containing the first liquid and the coloring material on the transfer body. Preferably, the image forming unit includes 1) a device that applies a first liquid composition containing the first liquid or a second liquid and an ink viscosity-increasing component onto the transfer body, and 2) a device that applies a second liquid composition containing the first liquid or the second liquid and the coloring material onto the transfer body, wherein the first image is formed as a mixture of the first and second liquid compositions. Generally, the second liquid composition is ink containing a coloring material, and the device that applies the second liquid composition onto the transfer body is an ink jet recording device. Further, the first liquid composition contains a component (ink viscosity-increasing component) chemically or physically acting with the second liquid composition to increase a viscosity of the mixture of the first and second liquid compositions more than a viscosity of each of the first and second liquid compositions. At least one of the first and second liquid compositions contains the first liquid. Here, an example of the first liquid includes a liquid having low volatility at room temperature, particularly water. The second liquid is a liquid except for the first liquid, and it does not matter whether volatility of the second liquid is high or low, but it is preferable that volatility of the second liquid is higher than that of the first liquid. Although disposition of a device that applies the first liquid composition to an ink receiving medium and a device that applies the second liquid composition to the ink receiving medium in the ink jet recording apparatus is not particularly limited, in view of high image quality of the image, it is preferable that a step of applying the first liquid composition onto the ink receiving medium and a step of applying a second liquid composition onto the ink receiving medium so as to at least partially overlap a region applied with the first liquid composition are sequentially performed. For this reason, it is preferable to dispose the device that applies the first liquid composition to the ink receiving medium and the device that applies the second liquid composition to the ink receiving medium so that the first liquid composition can be applied onto the ink receiving medium and the second liquid composition can be applied so as to at least partially overlap the region applied with the first liquid composition. Hereinafter, the first liquid composition is referred to as a "reaction liquid" and the device that applies the first liquid composition onto the transfer body is referred to as a "reaction liquid applying device". Further, the second liquid composition is referred to as an "ink" and the device that applies the second liquid composition onto the transfer body is referred to as an "ink applying device".

<Reaction Liquid Applying Device>

As the reaction liquid applying device, any device capable of applying the reaction liquid onto the transfer body may be used, and various devices known in the art can be suitably used. Specific examples thereof can include a gravure offset roller, an ink jet head, a die coating device (die coater), a blade coating device (blade coater), and the like. Application of the reaction liquid by the reaction liquid applying device may be performed before or after the ink is applied as long as the reaction liquid can be mixed (react) with the ink on the transfer body. It is preferable to apply the reaction liquid before the ink is applied. The reaction liquid is applied before the ink is applied, such that bleeding in which adjacently applied inks are mixed with each other at the time of recording an image by an ink jet method or beading in which previously landed ink is attracted to the ink landed later can be also suppressed.

<Reaction Liquid>

The reaction liquid is not particularly limited as long as it can satisfy the relationship of Equation (1), but it is preferable that the reaction liquid contains the ink viscosity-increasing component. To increase the viscosity of the ink includes a case in which the coloring material, a resin, etc., which is a portion of a composition constituting the ink, comes in contact with the ink viscosity-increasing component to thereby chemically react therewith or be physically adsorbed therein, and thus an increase in the viscosity of the entire ink is recognized, or a case in which the components constituting the ink such as the coloring material are partially aggregated and thus the viscosity is locally increased. The ink viscosity-increasing component has an effect of suppressing bleeding or beading at the time of forming the first image by partially decreasing fluidity of the ink and/or an ink composition on the transfer body. As the ink viscosity-increasing component as described above, materials known in the art such as a polyvalent metal ion, an organic acid, a cation polymer, porous fine particles, and the like can be used. Among them, particularly, the polyvalent metal ion and the organic acid are preferable. Further, it is preferable that plural kinds of ink viscosity-increasing components are contained in the reaction liquid. Further, a content of the ink viscosity-increasing component in the reaction liquid is preferably 5 mass % or more based on a total mass of the reaction liquid.

Examples of the polyvalent metal ion can include divalent metal ions such as $Ca^{2+}$, $Cu^{2+}$, $Ni^{2+}$, $Mg^{2+}$, $Sr^{2+}$, $Ba^{2+}$, and $Zn^{2+}$ or trivalent metal ions such as $Fe^{3+}$, $Cr^{3+}$, $Y^{3+}$, and $Al^{3+}$.

Further, examples of the organic acid can include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, dioxysuccinic acid, and the like.

The reaction liquid can include a suitable amount of water or a low-volatile organic solvent as the first liquid. It is preferable that water used in this case is deionized water by ion exchange or the like. Further, the organic solvent capable of being used in the reaction liquid applied to the present invention is not particularly limited, but an organic solvent known in the art can be used.

Further, the reaction liquid of which surface tension or a viscosity is suitably adjusted by adding a surfactant or a viscosity adjusting agent can be used. A material to be used is not particularly limited as long as it can coexist with the ink viscosity-increasing component. Specific examples of the surfactant to be used can include an acetylene glycol ethylene oxide adduct (trade name: "Acetylenol E100", manufactured by Kawaken Fine Chemicals Co., Ltd.), a perfluoroalkyl ethylene oxide adduct (trade name: "Megaface F444", product name manufactured by DIC Corporation), and the like.

<Ink Applying Device>

As the ink applying device that applies the ink, an ink jet head can be used. Examples of the ink jet head can include an ink jet head discharging ink by generating film boiling in the ink using an electro-thermal transducer to form bubbles, an ink jet head discharging ink by an electro-mechanical transducer, an ink jet head discharging ink using static electricity, and the like. In the present invention, an ink jet head known in the art can be used. Among them, particularly, an ink jet head using the electro-thermal transducer is preferably used in view of high-speed and high-density printing. Drawing is performed by receiving an image signal and applying a required amount of ink to each position.

An ink application amount can be expressed by an image density (duty) or an ink thickness, but in the present invention, an average value obtained by multiplying a mass of each ink dot by the number of ink dots and dividing the resultant by a printed area is defined as the ink application amount ($g/m^2$). In addition, a maximum ink application amount in an image region means an ink application amount applied in an area of at least 5 $mm^2$ in a region used as information of the transfer body in view of removing the liquid content in the ink.

The ink jet recording apparatus according to the present invention may have a plurality of ink jet heads for applying color ink of each color onto the transfer body. For example, in the case of forming respective color images using yellow ink, magenta ink, cyan ink, and black ink, the ink jet recording apparatus has four ink jet heads discharging four kinds of inks onto the transfer body, respectively. Further, the ink applying device may include an ink jet head discharging ink (clear ink) that does not contain a coloring material.

<Ink>

The ink applied to the present invention is not particularly limited as long as it can satisfy the relationship of Equation (1), but can contain, for example, each of the following components.

(Coloring Material)

It is preferable that the coloring material contained in the ink applied to the present invention contains a pigment. For example, as the coloring material, a pigment or a mixture of a dye and a pigment is preferably used. The kind of pigment capable of being used as the coloring material is not particularly limited. Specific examples of the pigment can include inorganic pigments such as carbon black; and organic pigments such as azo based pigments, phthalocyanine based pigments, quinacridone based pigments, isoindolinone based pigments, imidazolone based pigments, diketopyrrolopyrrole based pigments, and dioxazine based pigments. If necessary, one kind or two or more kinds of these pigments can be used.

The kind of dye capable of being used as the coloring material is not particularly limited. Specific examples of the dye can include direct dyes, acidic dyes, basic dyes, disperse dyes, edible dyes, and the like, and dyes having anionic groups can be used. Specific examples of a dye skeleton can include an azo skeleton, a triphenylmethane skeleton, a phthalocyanine skeleton, an azaphthalocyanine skeleton, a xanthene skeleton, an anthrapyridone skeleton, and the like.

A content of the pigment in the ink is preferably 0.5 mass % or more and 15.0 mass % or less and more preferably 1.0 mass % or more and 10.0 mass % or less based on a total mass of the ink.

(Dispersant)

As a dispersant dispersing the pigment, known dispersants used in ink for ink jet can be used. Among them, in the exemplary embodiment of the present invention, it is preferable to use a water-soluble dispersant simultaneously having a hydrophilic portion and a hydrophobic portion in a structure. Particularly, a pigment dispersant made of a resin obtained by copolymerizing at least a hydrophilic monomer and a hydrophobic monomer is preferably used. Here, there is no particular limitation in the used monomers, and monomers known in the art are preferably used. Specific examples of the hydrophobic monomer can include styrene and other styrene derivatives, alkyl(meth)acrylate, benzyl(meth)acrylate, and the like. Further, examples of the hydrophilic monomer can include acrylic acid, methacrylic acid, maleic acid, and the like.

It is preferable that an acid value of the dispersant is 50 mgKOH/g or more and 550 mgKOH/g or less. Further, a weight average molecular weight of the dispersant is preferably 1000 or more and 50000 or less. In addition, it is preferable that a mass ratio of the pigment and the dispersant is in a range of 1:0.1 to 1:3 (pigment:dispersant).

Further, in the present invention, it is also preferable to use a so-called self-dispersible pigment in which the pigment itself is surface-modified so that the pigment can be dispersed without using a dispersant.

(Resin Fine Particles)

The ink applied to the present invention can contain various fine particles that do not have a coloring material. Among them, resin fine particles are preferable in that the resin fine particles have an effect of improving image quality or fixability.

A material of the resin fine particles capable of being used in the present invention is not particularly limited, but a resin known in the art can be suitably used. Specific examples of the resin can include homopolymers such as polyolefin, polystyrene, polyurethane, polyester, polyether, polyurea, polyamide, polyvinyl alcohol, poly(meth)acrylic acid and salts thereof, alkyl poly(meth)acrylate, polydiene, and the like; or copolymers obtained by polymerizing a combination of a plurality of monomers for producing these homopolymers. A weight average molecular weight (Mw) of the resin is preferably in a range of 1,000 or more and 2,000,000 or less. Further, an amount of resin fine particles in the ink is preferably 1 mass % or more and 50 mass % or less and more preferably 2 mass % or more and 40 mass % or less based on the total mass of the ink.

Further, in the exemplary embodiment of the present invention, it is preferable to use a resin fine particle dispersion in which the resin fine particles are dispersed in a liquid. A dispersion method is not particularly limited, but a so-called self-dispersible resin fine particle dispersion in which resin fine particles are dispersed using a resin obtained by homopolymerizing a monomer having a dissociable group or copolymerizing a plurality of kinds of monomers is preferable. Here, an example of the dissociable group can include a carboxyl group, a sulfonic acid group, a phosphoric acid group, or the like, and an example of the monomer having such a dissociable group can include acrylic acid, methacrylic acid, or the like. In addition, similarly, a so-called emulsified dispersion type resin fine particle dispersion in which resin fine particles are dispersed using an emulsifier can also be preferably used in the present invention. Here, as the emulsifier, a surfactant known in the art is preferable regardless of a low molecular weight and a high molecular weight. It is preferable that the surfactant is a non-ionic surfactant or a surfactant having the same charge as that of the resin fine particles.

The resin fine particle dispersion used in the exemplary embodiment of the present invention has a dispersed particle diameter of preferably 10 nm or more and 1000 nm or less, more preferably 50 nm or more and 500 nm or less, and further more preferably 100 nm or more to 500 nm or less.

It is also preferable to add various additives for stabilization at the time of preparing the resin fine particle dispersion used in the exemplary embodiment of the present invention. Examples of the additive can include n-hexadecane, dodecyl methacrylate, stearyl methacrylate, chlorobenzene, dodecyl mercaptan, a blue dye (bluing agent), polymethyl methacrylate, and the like.

(Curable Component)

In the present invention, it is preferable that any one of the reaction liquid and the ink contains a component that is cured by active energy rays. Sometimes, coloring material adhesion to the liquid absorbing member is suppressed by curing the component that is cured by active energy rays before a liquid absorbing step.

As the component that is cured by irradiation with active energy rays, used in the present invention, a component that is cured by irradiation with active energy rays and becomes less soluble than before irradiation is used. For example, a general ultraviolet (UV)-curable resin can be used. Many of the UV-curable resins are insoluble in water, but as a material that can be applied to water-based ink suitably used in the present invention, a UV-curable resin having a hydrophilic bonding group while having at least an ethylenically unsaturated bond curable by ultraviolet rays is preferable. Examples of the hydrophilic bonding group can include a hydroxyl group, a carboxyl group, a phosphoric acid group, a sulfonic acid group and salts thereof, an ether bond, an amide bond, and the like. Further, the curable component used in the present invention is preferably hydrophilic.

Further, examples of the active energy rays can include UV rays, infrared rays, electron beams, and the like.

Further, it is preferable that any one of the reaction liquid and the ink in the present invention contains a polymerization initiator. The polymerization initiator used in the present invention is not particularly limited as long as it is a compound generating radicals by the active energy rays.

Further, in order to increase a reaction rate, it is also preferable to use a sensitizer serving to widen a light absorption wavelength together.

(Surfactant)

The ink capable of being used in the present invention may contain a surfactant. Specific examples of the surfactant can include an acetylene glycol ethylene oxide adduct ("Acetylenol E100", manufactured by Kawaken Fine Chemicals Co., Ltd.) and the like. A content of the surfactant in the ink is preferably 0.01 mass % or more and 5.0 mass % or less based on the total mass of the ink.

(Water and Water-Soluble Organic Solvent)

The ink used in the present invention can contain water and/or a water-soluble organic solvent as a solvent. It is preferable that water is deionized water by ion exchange or the like. Further, a content of water in the ink is preferably 30 mass % or more and 97 mass % or less and more preferably 50 mass % or more and 95 mass % or less based on the total mass of the ink.

In addition, the kind of used water-soluble organic solvent is not particularly limited, but all the organic solvents known in the art can be used. Specific examples of the water-soluble organic solvent can include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, methanol, and the like. Of course, a mixture of two or more selected from these water-soluble organic solvents can also be used.

In addition, a content of the water-soluble organic solvent in the ink is preferably 3 mass % or more and 70 mass % or less based on the total mass of the ink.

(Other Additives)

If necessary, the ink capable of being used in the present invention may contain various additives such as a pH adjusting agent, a rust preventive, an antiseptic, an antifungal agent, an antioxidant, a reduction inhibitor, a water-soluble resin and a neutralizing agent thereof, and a viscosity modifier in addition to the above-mentioned components.

[Liquid Absorbing Device]

The liquid absorbing device according to the present invention includes the liquid absorbing member having the porous body coming in contact with the first image to at least partially absorb the first liquid from the first image, and the cleaning member coming in contact with the porous body to remove the adhered substance adhered to the porous body. The first liquid is at least partially removed from the first image by contacting the liquid absorbing member having the porous body with the first image containing the first liquid and the coloring material on the transfer body. As a result, curls or cockling due to excessive absorption of the first liquid in the first image by the recording medium such as paper is suppressed. Further, there is no need to absorb the entire first liquid.

Here, when the first liquid is at least partially absorbed from the first image on the transfer body by the porous body, sometimes the first image (ink aggregate) is partially adhered to the porous body. The adhered substance adhered to the porous body may be re-transferred to the transfer body when the first liquid is at least partially absorbed from another first image by the porous body again, and when the adhered substance is re-transferred, an image defect occurs.

For example, in the case of printing a yellow image after printing a cyan image, sometimes, an image defect in which cyan spots are scattered on the yellow image occurs. When a liquid is absorbed from the cyan image printed on the transfer body first by the porous body, sometimes, even a small amount of a coloring material as a solid content contained in the ink is moved to a surface of the porous body simultaneously with absorption of the excessive liquid. In this case, since a cyan coloring material moves to thereby be re-transferred to the yellow image on the transfer body at the time of absorbing liquid from the yellow image printed on the transfer body later, finally, an image defect in which the cyan spots are scattered on the yellow image on the recording medium occurs. In order to prevent the image defect by the re-transfer as described above from occurring, it can be considered to perform a cleaning step of contacting the cleaning member with the porous body to remove the first image containing the coloring material adhered to the porous body.

However, it can be appreciated that depending on a combination of the materials constituting each member, sometimes, coloring material adhesion to the porous body occurs, sufficient cleaning performance cannot be obtained in the cleaning step, and the first image that is not cleaned can be re-transferred in some cases. As a result of detailed investigation by the present inventors, it was found that an adhesion amount of the coloring material to the porous body and re-transferability are changed in relation to the dispersion force component of the surface free energy of the first image formed on the transfer body and surface free energy of the transfer body, the porous body, and the cleaning member that come in contact with the first image.

That is, in the present invention, surface free energy $Y_1$ of the transfer body, surface free energy $Y_2$ of the porous body, surface free energy $Y_3$ of the cleaning member, and the dispersion force component $Y_d$ of surface free energy of the first image satisfy the following Equation (1).

$$|Y_d-Y_3|<|Y_d-Y_1|<|Y_d-Y_2| \quad (1)$$

$Y_1$ to $Y_3$ and $Y_d$ satisfy Equation (1), such that adhesion of the first image containing the coloring material to the porous body, that is, coloring material adhesion is suppressed when the first liquid is at least partially absorbed from the first image by the porous body. Further, even in the case in which the first image is adhered to the porous body, it is possible to suppress the adhered first image from being re-transferred when the first liquid is at least partially absorbed again from another first image by the porous body. A detail mechanism to suppress coloring material adhesion and re-transfer in a case in which $Y_1$ to $Y_3$ and $Y_d$ satisfy Equation (1) was not yet found, but the present inventors estimated as follows.

An adhesion work $W_{ab}$ indicating adhesive force between two substances coming in contact with each other is represented by the following Equation.

$$W_{ab}=Y_a+Y_b-Y_{ab}$$

In Equation, $Y_a$ and $Y_b$ indicate surface free energies of substances, respectively, and $Y_{ab}$ indicates interfacial free energy of two substances. As illustrated in Equation, the adhesion work $W_{ab}$ is considered to be the remaining energy obtained by subtracting the interfacial free energy ($Y_{ab}$) of two substances from a sum ($Y_a+Y_b$) of the surface free energies of the respective substances.

Figure 4:
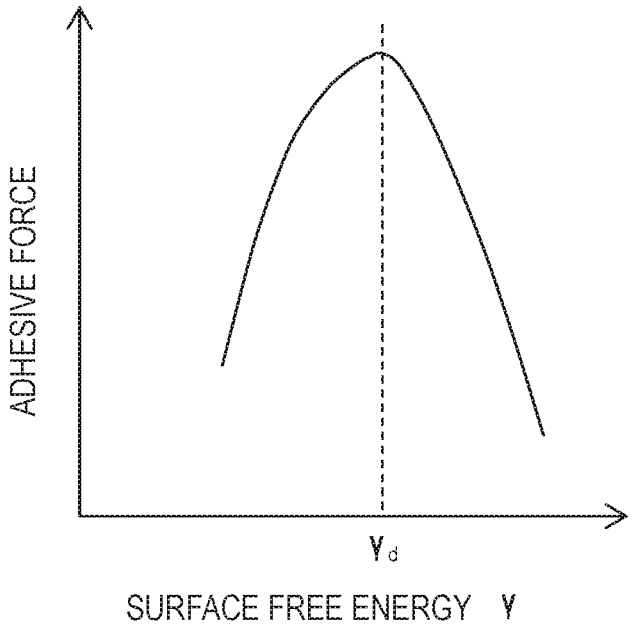
FIG. 4 is a graph illustrating a relationship of a dispersion force component of surface free energy of a first image and surface free energy of a certain substance to adhesive force between the first image and the substance in a case in which the first image and the substance come in contact with each other.

Here, in a case in which the first image and a certain substance come in contact with each other, a relationship of a dispersion force component of the surface free energy of the first image and surface free energy of the substance to adhesive force between the first image and the certain substance, found by the present inventors, is illustrated in FIG. 4 as an image. The present inventors found that as a value of surface free energy Y of a certain substance approaches a value of the dispersion force component $Y_d$ of the surface free energy of the first image, adhesive force of the certain substance to the first image is increased as illustrated in FIG. 4. In the Equation, considering the adhesion work of the first image and the certain substance, it is estimated that as the value of surface free energy Y of the certain substance approaches the value of the dispersion force component $Y_d$ of the surface free energy of the first image, the interfacial free energy is decreased, and as a result, adhesion work, that is, adhesive force is increased.

It is thought that in order to suppress coloring material adhesion, the first image needs to be more easily adhered to the transfer body than the porous body. Further, it is thought that in order to remove the first image with the cleaning member even though the first image is adhered to the porous body, the first image needs to be more easily adhered to the cleaning member than the porous body. In addition, it is thought that in order to prevent the first image from being re-transferred to the transfer body even though the first image is not removed by the cleaning member, the first image needs to be more easily adhered to the cleaning member than the transfer body. The reason may be that the first image that cannot be removed by the cleaning member is not adhered to the transfer body having lower adhesive force than that of the cleaning member. Therefore, it is thought that in order to suppress coloring material adhesion and re-transfer, adhesive force to the first image needs to satisfy the following relationship: porous body<transfer body<cleaning member.

Considering the above-mentioned adhesion work equation and the relationship between the surface free energy and the adhesive force illustrated in FIG. 4, the relationship of Equation (1) is satisfied, such that the adhesive force to the first image satisfies the following relationship: porous body<transfer body<cleaning member. For this reason, as a result, it is estimated that coloring material adhesion and re-transfer are suppressed. Further, in Equation (1), $Y_1$ to $Y_3$ indicate surface free energy Y in Kitasaki-Hata Equation represented by the following Equation. Further, $Y_d$ indicates a dispersion force component $Y_d$ in Kitasaki-Hata Equation represented by the following Equation. More specifically, $Y_1$ to $Y_3$ and $Y_d$ are values measured by a method to be described below.

$$Y=Y_d+Y_p+Y_h$$

Y: Surface free energy
$Y_d$: Dispersion force component
$Y_p$: Polar component
$Y_h$: Hydrogen bond component.

In view of suppressing coloring material adhesion and re-transfer, it is preferable that respective values of $Y_1$ to $Y_3$ and $Y_d$ satisfy the relationship of following Equation (2).

$$Y_2<Y_3<Y_d<Y_1 \quad (2)$$

The reason why the coloring material adhesion and re-transfer are suppressed by satisfying the relationship of Equation (2) is estimated as follows. With regard to the porous body, it is thought that when surface free energy of the porous body is small, the porous body is less likely to be wettable with respect to the first image, such that coloring material adhesion is further suppressed. Further, with regard to the first image and the transfer body, it is thought that when the dispersion force component of the surface free energy of the first image is smaller than the surface free energy of the transfer body, it is easier for the first image to be temporarily fixed on the transfer body, such that at the time of absorbing the first liquid, occurrence of coloring material adhesion is difficult. With regard to the cleaning member, it is thought that the closer the surface free energy of the cleaning member is to the dispersion force component of the surface free energy of the first image, the more preferable. However, as illustrated in FIG. 4, adhesive force to the first image is not exactly symmetrical with respect to $Y_d$ of the first image but is distorted, and it is thought that the surface free energy of the cleaning member is smaller than $Y_d$, which is more advantageous in view of adhesive force.

The value of $Y_1$ is not particularly limited, but in view of forming a good quality image, $Y_1$ satisfies preferably 20 mN/m≤$Y_1$≤60 mN/m, more preferably 30 mN/m≤$Y_1$≤50 mN/m, and further more preferably 35 mN/m≤$Y_1$≤45 mN/m.

The value of $Y_2$ is not particularly limited, but in view of preventing coloring material adhesion, $Y_2$ satisfies preferably 5 mN/m≤$Y_2$≤40 mN/m, more preferably 10 mN/m≤$Y_2$≤30 mN/m, and further more preferably 15 mN/m≤$Y_2$≤20 mN/m.

The value of $Y_3$ is not particularly limited, but in view of improving a cleaning property, $Y_3$ satisfies preferably 10 mN/m≤$Y_3$≤50 mN/m, more preferably 20 mN/m≤$Y_3$≤40 mN/m, and further more preferably 25 mN/m≤$Y_3$≤35 mN/m.

The value of $Y_d$ is not particularly limited, but in view of forming a good quality image, $Y_d$ satisfies preferably 20 mN/m≤$Y_d$≤50 mN/m, more preferably 25 mN/m≤$Y_d$≤40 mN/m, and further more preferably 30 mN/m≤$Y_d$≤35 mN/m.

In view of forming a good-quality image and improving the cleaning property, it is preferable that a Shore hardness of a material constituting the transfer body is higher than a Shore hardness of a material constituting the cleaning member. The Shore hardness of the material constituting the transfer body is preferably at least 10 higher, more preferably at least 20 higher than that of the material constituting the cleaning member. Further, the material constituting the transfer body means a material forming a surface of the transfer body. This is also similarly applied to the material constituting the cleaning member. In addition, the Shore hardness is a value measured by a method to be described below. The Shore hardness of the material constituting the transfer body is preferably 20 to 60 and more preferably 30 to 50. The Shore hardness of the material constituting the cleaning member is preferably 5 to 50 and more preferably 10 to 30.

Further, in view of improving the cleaning property, it is preferable that a surface roughness Ra of the cleaning member is larger than a surface roughness Ra of the transfer body. The surface roughness Ra of the cleaning member is preferably at least 0.2 μm larger, and more preferably at least 0.5 μm larger than the surface roughness Ra of the transfer body. In addition, the surface roughness Ra is a value measured by a method to be described below. The surface roughness Ra of the cleaning member is preferably 0.5 to 5.0 μm and more preferably 0.8 to 2.0 μm. The surface roughness Ra of the transfer body is preferably 0.1 to 2.0 μm and more preferably 0.3 to 1.0 μm.

In addition, it is preferable that the liquid absorbing device according to the present invention further includes a liquid applying member that applies a third liquid onto the porous body, and a liquid removing member that partially removes the third liquid from the porous body applied with the third liquid. It is possible to prevent the first liquid absorbed in the porous body from being viscously thickened and allow liquid distribution in the porous body to be uniform by applying the third liquid onto the porous body. Further, an empty volume in the porous body, required to absorb the first liquid from the first image by the porous body next time can be secured by partially removing the third liquid from the porous body applied with the third liquid.

<Liquid Absorbing Member>

In the present invention, a content of the liquid component in the first image is decreased by contacting the first image with the liquid absorbing member having the porous body to at least partially remove the first liquid from the first image. A contact surface of the liquid absorbing member with the first image is defined as a first surface, and the porous body is disposed on the first surface. The liquid absorbing member having the porous body as described above can have a shape in which the liquid absorbing member can absorb the liquid by circulating and coming in contact with another first image at a predetermined cycle after moving in sync with movement of the transfer body to come in contact with the first image. For example, the liquid absorbing member can have an endless belt shape, a drum shape, or the like.

(Porous Body)

Hereinafter, the porous body is described. Further, in the present invention, it is preferable that the porous body is a material having a large number of pores. For example, a material having a large number of pores formed by intersection of fibers is also included in the porous body of the present invention.

As the porous body of the liquid absorbing member according to the present invention, it is preferable to use a porous body having an average pore diameter on a first surface side smaller than an average pore diameter on a second surface side opposite to the first surface. In order to suppress coloring material adhesion to the porous body, it is preferable that the pore diameter is small. It is preferable that the average pore diameter of the porous body on at least the first surface side, contacting the first image is 10 μm or less. Further, in the present invention, the average pore diameter means an average diameter at the first or second surface, and can be measured by a method known in the art, for example, a mercury press-in method, a nitrogen adsorption method, an SEM image observation method, or the like.

Further, it is preferable to decrease a thickness of the porous body in order to obtain uniformly high air permeability. Air permeability can be expressed by a Gurley value defined in JIS P8117, and it is preferable that the Gurley value is 10 seconds or less.

However, in the case of decreasing the thickness of the porous body, sometimes, the porous body fails to secure a capacity enough to absorb the liquid component. Therefore, the porous body can have a multilayer configuration. Further, in the liquid absorbing member, a layer coming in contact with the first image may be the porous body, and a layer that does not come in contact with the first image may not be the porous body.

Next, an exemplary embodiment in which the porous body has a multilayer configuration is described. Here, a layer on a side in contact with the first image is defined and described as a first layer and a layer laminated on a surface of the first layer opposite to a contact surface of the first layer with the first image is defined and described as a second layer. Further, in the multilayer configuration, respective layers are sequentially expressed in the order of lamination from the first layer. Further, in the present specification, the first layer may be referred to as an "absorption layer" and the second layer and subsequent layers may be referred to as "support layer". Further, when the porous body has a single layer configuration, the first layer can be used as the porous body.

In the present invention, a material of the first layer is not particularly limited as long as the relationship of Equation (1) is satisfied. For example, both a hydrophilic material having a contact angle of less than 90° with respect to water and a water-repellent material having a contact angle of 90° or more with respect to water can be used. However, in view of suppressing coloring material adhesion and improving a cleaning property, the material of the first layer is preferably a water-repellent material having low surface free energy, particularly, a fluororesin. Specific examples of the fluororesin can include polytetrafluoroethylene (PTFE), polychlorotrifluoroethylene (PCTFE), polyvinylidene fluoride (PVDF), polyvinyl fluoride (PVF), a perfluoroalkoxy fluororesin (PFA), a tetrafluoroethylene.hexafluoropropylene copolymer (FEP), an ethylene.tetrafluoroethylene copolymer (ETFE), an ethylene.chlorotrifluoroethylene copolymer (ECTFE), and the like. Further, polyamideimde (PAI), polyimide (PI), and the like can be used. If necessary, one kind or two or more kinds of these resins can be used, and a configuration in which a plurality of films are laminated in the first layer may be adopted.

In the present invention, it is preferable that the first layer has a film thickness of 50 μm or less. It is more preferable that the film thickness is 30 μm or less. In the present invention, the film thickness is a value obtained by measuring film thicknesses at 10 random points using a linear micrometer OMV-25 (manufactured by Mitutoyo Corporation) and calculating an average value thereof.

The first layer can be manufactured by a method of manufacturing a thin porous film known in the art. For example, after obtaining a sheet-shaped object using a resin material by a method such as an extrusion molding method, the sheet-shaped object can be drawn at a predetermined thickness, thereby obtaining the first layer. Alternatively, a plasticizer such as paraffin can be added to a material for extrusion molding, and the plasticizer can be removed, for example, by heating at the time of drawing, thereby obtaining the first layer as a porous film. The pore diameter can be adjusted by appropriately adjusting an amount of the added plasticizer, a draw ratio, and the like.

In the present invention, it is preferable that the second layer is a layer having air permeability. This layer may be either a non-woven fabric or a woven fabric of resin fibers. A material of the second layer is not particularly limited, but in order to prevent the liquid absorbed in the first layer from flowing back, it is preferable that the material of the second layer is a material of which a contact angle with respect to the first liquid is equal to or lower than that of the first layer. Specifically, the material is preferably selected from single materials such as polyolefins (such as polyethylene (PE) and polypropylene (PP)), polyurethanes, polyamides such as nylon, polyesters (such as polyethylene terephthalate (PET)), and polysulfone (PSF), composite materials of them, or the like. Further, it is preferable that the second layer is a layer having a pore diameter larger than that of the first layer.

In the present invention, the porous body having a multilayer structure may be a configuration including three or more layers, but is not limited thereto. The third and subsequent layers are preferably made of non-woven fabric in view of rigidity. As a material, a material similar to that of the second layer is used.

The liquid absorbing member may include, in addition to the porous body having a multilayer structure, a reinforcing member that reinforces side surfaces of the liquid absorbing member. Further, the liquid absorbing member may also include an adhesive member in the case of connecting longitudinal end portions of a long sheet-shaped porous body to each other to form a belt-shaped member. As the material as described above, a non-porous tape material or the like can be used, and may be disposed at a position or a cycle at which it does not come in contact with the first image.

In the case in which the porous body has the multilayer structure, a method of laminating the first and second layers to form the porous body is not particularly limited. The first and second layers may be simply overlapped or bonded to each other by a method such as lamination by an adhesive agent or lamination by heating. In view of air permeability, lamination by heating is preferable in the present invention. Alternatively, for example, the first layer or the second layer may be partly melted by heating, and the layers may be adhesively laminated. In addition, a fusing material such as a hot melt powder may be interposed between the first and second layers, and the layers may be adhesively laminated by heating. When three or more layers are laminated, the layers may be laminated at once, or may be sequentially laminated, and a lamination order is appropriately selected. In a heating step, a lamination method in which the porous body is heated while the porous body is interposed between heated rollers and pressed is preferable.

<Cleaning Member>

In the present invention, the first image adhered to the porous body at the time of at least partially absorbing the first liquid from the first image by contacting the porous body with the first image is removed by the cleaning member (also referred to as the cleaning member for the liquid absorbing member). The cleaning member adsorbs and removes the first image by directly coming in contact with the porous body to which the first image is adhered. For example, the first image on the porous body can be adhered to the cleaning member to thereby be removed by inserting the porous body to which the first image is adhered between the cleaning member and a backup roller disposed at an opposite side with the porous body interposed therebetween.

A material constituting the cleaning member is not particularly limited as long as the relationship of Equation (1) is satisfied, but may be, for example, butyl rubber (also referred to as butyl), acrylonitrile.butadiene rubber (also referred to as NBR), styrene.butadiene rubber (also referred to as SBR), ethylene.propylene.diene rubber (also referred to as EPDM), or the like. One or a combination of two or more of these materials may be used.

A shape of the cleaning member is not particularly limited, but for example, the cleaning member can have a drum shape, an endless belt shape, or the like. The first image adhered to the cleaning member can be removed, for example, by adhering the first image to another roller coming in contact with the cleaning member.

<Liquid Applying Member>

The liquid applying member is not particularly limited as long as it can apply the third liquid onto the porous body. For example, the third liquid can be applied onto the porous body by contacting a roller applied with the third liquid with the porous body or dropping the third liquid on the porous body. Further, in the case of using the roller, a material or surface roughness of the roller can be changed depending on an amount of the third liquid applied onto the porous body or a viscosity of the used third liquid. The third liquid is not particularly limited as long as it can prevent the first liquid absorbed in the porous body from being viscously thickened and allow the liquid distribution of the porous body to be uniform, but it is preferable that the third liquid is a colorless transparent liquid having a low viscosity. Examples of the third liquid as described above can include pure water, ethanol, isopropanol, and the like. The liquid applying member may be disposed at any position, but it is preferable that the liquid applying member is disposed so as to be used after removing the adhered substance by the cleaning member, that is, disposed after the cleaning member.

<Liquid Removing Member>

The liquid removing member is not particularly limited as long as the liquid removing member can partially remove the third liquid from the porous body applied with the third liquid. For example, the third liquid held by the porous body can be partially blown by blowing air against the surface of the porous body opposite to the surface thereof coming in contact with the first image. The third liquid held by the porous body can be partially removed or collected by contacting cap or the like that generates negative pressure with the porous body. A removal amount of the third liquid is not particularly limited as long as an empty volume in the porous body required to absorb the first liquid from the first image by the porous body next time can be secured.

Next, a specific exemplary embodiment of the ink jet recording apparatus according to the present invention is described. FIG. 1 is a schematic diagram illustrating an example of a schematic configuration of an ink jet recording apparatus according to the present exemplary embodiment.

An ink jet recording apparatus 100 includes a transfer body 101 temporarily holding a first image and a second image obtained by at least partially absorbing a first liquid from the first image. Further, the ink jet recording apparatus 100 (also referred to as a transfer type ink jet recording apparatus) includes a transfer unit (also referred to a transfer device) including a pressing member 106 for transferring the second image to a recording medium 108 on which an image will be formed.

The ink jet recording apparatus 100 according to the present exemplary embodiment includes the transfer body 101 supported by a support member 102, a reaction liquid applying device 103 applying a reaction liquid onto the transfer body 101, an ink applying device 104 applying ink onto the transfer body 101 applied with the reaction liquid to form an ink image (first image) on the transfer body 101, a liquid absorbing device 105 absorbing a liquid component from the first image on the transfer body 101, and a pressing member 106 transferring a second image on the transfer body 101 from which the liquid component has been removed on the recording medium 108 such as paper by pressing the recording medium. Further, the ink jet recording apparatus 100 may include a transfer body cleaning member 109 (also referred to as a cleaning member for a transfer body) cleaning a surface of the transfer body 101 after the second image is transferred to the recording medium 108.

The support member 102 rotates based on a rotation shaft 102*a* of the support member 102 in an arrow direction of FIG. 1. The transfer body 101 is moved in the arrow direction by rotation of the support member 102. The reaction liquid and the ink are sequentially applied onto the moved transfer body 101 by the reaction liquid applying device 103 and the ink applying device 104, respectively, such that the first image is formed on the transfer body 101. The first image formed on the transfer body 101 is moved by movement of the transfer body 101 to a position at which the first image comes in contact with a liquid absorbing member 105*a* of the liquid absorbing device 105.

The liquid absorbing member 105*a* of the liquid absorbing device 105 moves in sync with rotation of the transfer body 101. The first image formed on the transfer body 101 comes in contact with the moving liquid absorbing member 105*a* described above. During the contact, the liquid absorbing member 105*a* removes the liquid component from the first image.

Further, the liquid component contained in the first image is removed in a state coming in contact with the liquid absorbing member 105*a*. In view of allowing the liquid absorbing member 105*a* to effectively function, it is preferable that the liquid absorbing member 105*a* is pressed on the first image with predetermined pressing force in this contact state.

The removal of the liquid component can be expressed from a different point of view as concentrating the ink constituting the first image formed on the transfer body 101. Concentrating the ink means that the proportion of the solid content contained in the ink, such as the coloring material and a resin, with respect to the liquid component contained in the ink increases owing to reduction in the liquid component.

In addition, the second image after removing the liquid component is moved by movement of the transfer body 101 to the transfer unit coming in contact with the recording medium 108 conveyed by a recording medium conveyance device 107. While the second image after removing the liquid component comes in contact with the recording medium 108, the pressing member 106 presses the recording medium 108, such that an ink image is formed on the recording medium 108. The ink image after transfer that is transferred onto the recording medium 108 is an inverse image of the second image. In the following description, separately from the first image (ink image before liquid removal) and the second image (ink image after liquid removal), the ink image after transfer may also be referred to as a third image.

Further, since the first image is formed by applying the ink after applying the reaction liquid onto the transfer body 101, the reaction liquid has not reacted with the ink but remains in a non-image region (non-ink image forming region). In the present apparatus, the liquid absorbing member 105*a* comes in contact (pressure-contact) with an un-reacted reaction liquid to remove the liquid component in the reaction liquid from a surface image of the transfer body 101 together in addition to removing the liquid component from the first image.

Therefore, in the above description, although it is expressed and explained that the liquid component is removed from the first image, the expression is not limited to removal of the liquid component from only the first image, but is used in the sense that the liquid component may be removed at least from the first image on the transfer body 101. For example, it is also possible to remove the liquid component in the reaction liquid applied onto a region outside the first image together with the first image.

Further, the liquid component is not particularly limited as long as the liquid component does not have a constant shape and has fluidity and an almost constant volume. Examples of the liquid component can include water, an organic solvent, and the like contained in the ink or the reaction liquid.

Further, even in the case in which the above-mentioned clear ink is contained in the first image, the ink can be concentrated by liquid absorption treatment. For example, when the clear ink is applied onto color ink containing a coloring material, applied onto the transfer body 101, the clear ink is entirely present on a surface of the first image, or the clear ink is partially present on one or two or more portions of the surface of the first image, and the color ink is present in other portions. In the portions of the first image on which the clear ink is present on the color ink, the porous body absorbs a liquid component of the clear ink on the surface of the first image, such that the liquid component of the clear ink is moved. Therefore, the liquid component in the color ink moves toward the porous body, such that the liquid component in the color ink is absorbed. On the other hand, in the portions in which a region of the clear ink and a region of the color ink are present on the surface of the first image, each of the liquid components in the color ink and the clear ink are moved toward the porous body, such that the liquid components are absorbed. Further, the clear ink may contain a large amount of a component for improving transferability of the image from the transfer body 101 to the recording medium 108. For example, a content of a component increasing an adhesion property to the recording medium by heating may be increased to be higher than that of the color ink.

Each configuration of the ink jet recording apparatus according to the present exemplary embodiment is described below.

<Transfer Body>

The transfer body 101 has a surface layer having an image forming surface. A member of the surface layer is not particularly limited as long as the relationship of Equation (1) is satisfied, but various materials such as a resin, ceramics, and the like can be suitably used. However, in view of durability and the like, a material having high compressive elastic modulus is preferable. Specific examples thereof can include an acrylic resin, an acrylic silicone resin, a fluorine-containing resin, a condensate prepared by condensation of a hydrolyzable organic silicon compound, NBR, and the like. In order to improve wettability of the reaction liquid, transferability, and the like, surface treatment may be performed. Examples of the surface treatment can include flame treatment, corona treatment, plasma treatment, polishing treatment, roughening treatment, active energy ray-irradiation treatment, ozone treatment, surfactant treatment, silane coupling treatment, and the like. A combination of two kinds or more of these treatments may be performed. In addition, an arbitrary surface shape can also be provided on the surface layer.

Further, it is preferable that the transfer body 101 has a compressible layer having a function of absorbing pressure fluctuations. The compressible layer is provided, such that the compressible layer can absorb deformation to disperse local pressure fluctuations, thereby making it possible to maintain satisfactory transferability even during high-speed printing. As a material of the compressible layer, for example, acrylonitrile-butadiene rubber, acrylic rubber, chloroprene rubber, urethane rubber, silicone rubber, and the like can be used. At the time of molding such a rubber material, it is preferable to add predetermined amounts of a vulcanizing agent, a vulcanization accelerator, and the like, and to further add a foaming agent, hollow fine particles, or a filler such as sodium chloride as needed to form a porous material. Therefore, since bubble portions are compressed with volume changes against various pressure fluctuations, deformation except in a compression direction is small, and more stable transferability and durability can be achieved. As a porous rubber material, there are a material having a continuous pore structure in which pores are connected to each other and a material having an independent pore structure in which pores are independent of each other. In the present invention, any one of the structures may be used, or the structures may be used in combination.

Further, the transfer body 101 preferably includes an elastic layer between the surface layer and the compressible layer. As a material of the elastic layer, various materials such as resins, ceramics, and the like can be suitably used. In view of processing properties, various elastomer materials and rubber materials are preferably used. Specific examples thereof can include fluorosilicone rubber, phenylsilicone rubber, fluororubber, chloroprene rubber, urethane rubber, nitrile rubber, ethylenepropylene rubber, natural rubber, styrene rubber, isoprene rubber, butadiene rubber, ethylene/propylene/butadiene copolymers, nitrile-butadiene rubber, and the like. Particularly, in view of dimensional stability and durability, since silicone rubber, fluorosilicone rubber, and phenylsilicone rubber have a small compression permanent set, these materials are preferable. Further, in view of a small change in elastic modulus depending on a temperature and transferability, these materials are preferable.

Various adhesives or double-sided tapes may be used between the respective layers (the surface layer, the elastic layer, and the compressible layer) constituting the transfer body 101 in order to fix/hold these layers. In addition, the transfer body 101 may also include a reinforcing layer having a high compressive elastic modulus in order to suppress lateral elongation when installed in an apparatus or to maintain elasticity. Further, a woven fabric may be used as the reinforcing layer. The transfer body 101 can be manufactured by optionally combining the respective layers made of the above-mentioned materials.

A size of the transfer body 101 can be freely selected depending on a size of a target print image. A form of the transfer body 101 is not particularly limited. Specific examples of the form of the transfer body 101 can include a sheet form, a roller form, a belt form, an endless web form, and the like.

<Support Member>

The transfer body 101 is supported on the support member 102. As a method of supporting the transfer body 101, various adhesives or double-sided tapes may be used. Alternatively, the transfer body 101 may be supported on the support member 102 using an installing member by attaching the installing member made of a metal, ceramics, a resin, or the like to the transfer body 101.

The support member 102 needs to have a certain degree of structural strength in view of conveyance accuracy and durability. As a material of the support member, metals, ceramics, resins, and the like are preferably used. Among them, particularly, aluminum, iron, stainless steel, acetal resins, epoxy resins, polyimide, polyethylene, polyethylene terephthalate, nylon, polyurethane, silica ceramics, and alumina ceramics are preferably used in order to decrease inertia during the operation and improve control responsivity in addition to rigidity capable of withstanding the pressure at the time of transfer or dimensional accuracy. In addition, a combination thereof is preferably used.

<Reaction Liquid Applying Device>

The ink jet recording apparatus 100 according to the present exemplary embodiment includes the reaction liquid applying device 103 applying the reaction liquid onto the transfer body 101. A case in which the reaction liquid applying device 103 is a gravure offset roller having a reaction liquid storage unit 103*a* storing the reaction liquid and reaction liquid applying members 103*b* and 103*c* applying the reaction liquid in the reaction liquid storage unit 103*a* onto the transfer body 101 is illustrated in FIG. 1.

<Ink Applying Device>

The ink jet recording apparatus 100 according to the present exemplary embodiment includes the ink applying device 104 applying the ink onto the transfer body 101 applied with the reaction solution. The reaction liquid and the ink are mixed with each other to form the first image, and the liquid component is absorbed from the first image in the following liquid absorbing device 105.

<Liquid Absorbing Device>

In the present exemplary embodiment, the liquid absorbing device 105 includes the liquid absorbing member 105*a* and a pressing member 105*b* for absorbing a liquid, which presses the liquid absorbing member 105*a* against the first image on the transfer body 101. Further, shapes of the liquid absorbing member 105*a* and the pressing member 105*b* are not particularly limited. For example, as illustrated in FIG. 1, the liquid absorbing device 105 may have a configuration in which the pressing member 105*b* has a column shape, the liquid absorbing member 105*a* has a belt shape, and the column-shaped pressing member 105*b* presses the belt-shaped liquid absorbing member 105*a* against the transfer body 101. Alternatively, the liquid absorbing device 105 may also have a configuration in which the pressing member 105*b* has a column shape, the liquid absorbing member 105*a* has a cylindrical shape formed on a peripheral surface of the column-shaped pressing member 105*b*, and the column-shaped pressing member 105*b* presses the cylindrical liquid absorbing member 105*a* against the transfer body. In the present invention, it is preferable that the liquid absorbing member 105*a* has a belt shape in consideration of a space in the ink jet recording apparatus 100, etc.

Further, the liquid absorbing device 105 including the belt-shaped liquid absorbing member 105*a* described above may also include an extending member extending the liquid absorbing member 105*a*. In FIG. 1, reference numerals 105*c*, 105*d*, and 105*e* denote extending rollers as the extending members. In FIG. 1, the pressing member 105*b* is a rotating roller member similarly to the extending roller, but is not limited thereto.

The liquid absorbing device 105 includes the liquid absorbing member 105*a* having the porous body and the pressing member 105*b* for absorbing a liquid, which presses the liquid absorbing member 105*a* against the first image on the transfer body 101. In addition, the liquid absorbing member 105*a* is allowed (pressed) to come in contact with the first image by the pressing member 105*b*, such that the liquid component contained in the first image is absorbed by the liquid absorbing member 105*a*, thereby obtaining the second image in which the liquid component is decreased from the first image. As a method of decreasing the liquid component in the first image, the present method of pressing the liquid absorbing member 105*a* may be combined with other various methods used in the art, for example, a heating method, a method of blowing air with low humidity, a decompression method, and the like. Further, the liquid component may be further decreased by applying these methods to the second image in which the liquid component has been decreased.

Hereinafter, various conditions and configurations in the liquid absorbing device 105 are described in detail.

(Pre-Treatment)

In the present exemplary embodiment, it is preferable to perform pre-treatment using a pre-treatment device (not illustrated in FIGS. 1 and 2) applying a wetting liquid (also referred to as a treatment liquid) to the liquid absorbing member before the liquid absorbing member 105*a* having the porous body comes in contact with the first image. The wetting liquid used in the present invention preferably contains water and a water-soluble organic solvent. It is preferable that water is deionized water by ion exchange or the like. In addition, the kind of used water-soluble organic solvent is not particularly limited, but all the organic solvents known in the art such as ethanol, isopropanol alcohol, or the like can be used. In pre-treatment of the liquid absorbing member used in the present invention, an application method of the wetting liquid to the porous body is not particularly limited, but a dipping method or a liquid droplet dropping method is preferable. Further, a component adjusting surface tension of the wetting liquid is not particularly limited, but it is preferable to use a surfactant. As the surfactant, it is preferable to use at least one of silicone based surfactants and fluorine based surfactants, and it is more preferable to use the fluorine based surfactant. Further, a content of the surfactant in the wetting liquid is preferably 0.2 mass % or more, more preferably 0.4 mass % or more, and further more preferably 0.5 mass % or more based on a total mass of the wetting liquid. Further, an upper limit of the content of the surfactant in the wetting liquid is not particularly limited, but in view of solubility of the surfactant in the wetting liquid, the upper limit of the content of the surfactant is preferably 10 mass % or less based on the total mass of the wetting liquid.

(Pressing Conditions)

A pressure (nip pressure) of the liquid absorbing member 105*a* pressing the first image on the transfer body 101 is 2.9 $N/cm^2$ (0.3 $kgf/cm^2$) or more, which is preferable in that the liquid component in the first image can be separated by solid-liquid separation within a shorter time, and the liquid component can be removed from the first image. Further, the pressure is 98 $N/cm^2$ (10 $kgf/cm^2$) or less, which is preferable in that a structural load to the apparatus can be suppressed. Further, in the present specification, the pressure of the liquid absorbing member 105*a* represents a nip pressure between the transfer body 101 and the liquid absorbing member 105*a*, and is a value calculated by performing surface pressure measurement using a surface pressure distribution measuring device (trade name: "I-SCAN", manufactured by Nitta Corporation), and dividing a load in a pressed region by an area.

(Application Time)

An application time during which the liquid absorbing member 105*a* comes in contact with the first image is preferably within 50 milliseconds (ms) in order to further suppress the coloring material in the first image from being adhered to the liquid absorbing member 105*a*. Further, in the present specification, the application time is calculated by dividing a pressure detection width in a movement direction of the transfer body 101 in the above-mentioned surface pressure measurement by a movement speed of the transfer body 101. Thereafter, this application time is referred to as a liquid absorbing nip time.

The liquid absorbing device 105 includes a cleaning member 105*f* (cleaning member for a liquid absorbing member) coming in contact with the liquid absorbing member 105*a* after absorbing the liquid from the first image, and a backup roller 105*g* disposed to be opposite to the cleaning member 105*f* with the liquid absorbing member 105*a* interposed therebetween. The first image adhered to the porous body is allowed to come in contact with a surface of the cleaning member 105*f* to thereby be removed by inserting the liquid absorbing member 105*a* to which the first image is partially adhered by absorbing the liquid from the first image between the cleaning member 105*f* and the backup roller 105*g*. Further, shapes of the cleaning member 105*f* and the backup roller 105*g* are not particularly limited.

In view of improving a cleaning property, a pressure (nip pressure) of the cleaning member 105*f* coming in pressure-contact with the liquid absorbing member 105*a* is preferably 2 $N/cm^2$ (0.2 $kgf/cm^2$) or more. Further, in view of durability of the liquid absorbing member 105*a*, the pressure is preferably 50 $N/cm^2$ (5.0 $kgf/cm^2$) or less. Further, in the present specification, the pressure of the cleaning member 105*f* is measured similarly to the pressure of the liquid absorbing member 105*a* coming in pressure-contact with the first image on the transfer body 101 described above.

An application time during which the cleaning member 105*f* comes in contact with the liquid absorbing member 105*a* is preferably within 500 milliseconds (ms) in view of durability of the liquid absorbing member 105*a*. Further, the application time is measured similarly to the application time during which the liquid absorbing member 105*a* comes in contact with the first image described above.

The liquid absorbing device 105 includes a third liquid storage unit 105*i* holding the third liquid, and a liquid applying member 105*h* applying the third liquid in the third liquid storage unit 105*i* to the liquid absorbing member 105*a*. The third liquid storage unit 105*i* is a liquid holding vessel accommodating the third liquid therein, and the liquid applying member 105*h* is partially dipped in the third liquid. The liquid applying member 105*h* comes in contact with the liquid absorbing member 105*a*, such that the third liquid pumped up to a surface of the liquid applying member 105*h* is applied to the porous body of the liquid absorbing member 105*a*. A pressure (nip pressure) of the liquid applying member 105*h* coming in pressure-contact with the liquid absorbing member 105*a*, an application amount of the third liquid, and the like are suitably set in a range in which it is possible to prevent the first liquid absorbed in the porous body from being viscously thickened and allow liquid distribution of the porous body to be uniform.

The liquid absorbing device 105 includes a liquid removing member 105*j* partially removing the third liquid by blowing air onto the liquid absorbing member 105*a* to which the third liquid is applied by the liquid applying member 105*h*. As illustrated in FIG. 1, it is preferable to allow the liquid removing member 105*j* to blow air against the surface of the liquid absorbing member 105*a* opposite to the surface thereof coming in contact with the first image. Further, although not illustrated in FIG. 1, the liquid absorbing device 105 may include a member collecting the third liquid blown by blowing air. A wind speed of the air, an angle of the blowing air, a removal amount of the third liquid, and the like are suitably set in a range in which the empty volume of the porous body required to absorb the first liquid from the first image by the porous body next time can be secured.

As described above, in the liquid absorbing device 105 illustrated in FIG. 1, the liquid absorbing member 105*a* which has absorbed the liquid from the first image is sequentially subjected to the cleaning step by the cleaning member 105*f*, a third liquid applying step by the liquid applying member 105*h*, and a third liquid removing step by the liquid removing member 105*j* to thereby be subjected to the liquid absorbing step from the first image again.

In this way, the liquid component is absorbed from the first image on the transfer body 101, such that the second image with a reduced liquid content is formed. Then, the second image is transferred onto the recording medium 108 in the transfer unit. A device configuration and conditions at the time of transfer are described.

<Pressing Member for Transferring>

In the present exemplary embodiment, while the second image is allowed to come in contact with the recording medium 108 conveyed by the recording medium conveyance device 107, the pressing member 106 for transferring presses the recording medium 108, such that the ink image is transferred onto the recording medium 108. It is possible to obtain a recording image in which curls, cockling, or the like is suppressed by removing the liquid component contained in the first image on the transfer body 101 and then transferring the ink image to the recording medium 108.

The pressing member 106 needs to have a certain degree of structural strength in view of conveyance accuracy of the recording medium 108 or durability. As a material of the pressing member 106, metals, ceramics, resins, and the like are preferably used. Among them, particularly, aluminum, iron, stainless steel, acetal resins, epoxy resins, polyimide, polyethylene, polyethylene terephthalate, nylon, polyurethane, silica ceramics, and alumina ceramics are preferably used in order to decrease inertia during the operation and improve control responsivity in addition to rigidity capable of withstanding the pressure at the time of transfer or dimensional accuracy. Further, these materials may be used in combination.

A pressing time during which the pressing member 106 presses the recording medium 108 in order to transfer the second image on the transfer body 101 to the recording medium 108 is not particularly limited, but is preferably 5 ms or more and 100 ms or less in order to satisfactorily transfer the second image and not to degrade durability of the transfer body. Further, in the present exemplary embodiment, the pressing time indicates a time during which the recording medium 108 and the transfer body 101 come in contact with each other, and is calculated by performing surface pressure measurement using a surface pressure distribution measuring device (trade name: "I-SCAN", manufactured by Nitta Corporation) and dividing a length of a pressed region in a conveyance direction by a conveyance speed.

Further, a pressure at which the pressing member 106 presses the recording medium 108 in order to transfer the second image on the transfer body 101 to the recording medium 108 is not particularly limited, but is determined so as to satisfactorily transfer the second image and not to degrade durability of the transfer body. Therefore, it is preferable that the pressure is 9.8 $N/cm^2$ (1 $kgf/cm^2$) or more and 294.2 $N/cm^2$ (30 $kgf/cm^2$) or less. Further, in the present exemplary embodiment, the pressure indicates a nip pressure between the recording medium 108 and the transfer body 101 and is calculated by performing surface pressure measurement using a surface pressure distribution measuring device and dividing a load in a pressed region by an area.

A temperature when the pressing member 106 presses the recording medium 108 in order to transfer the second image on the transfer body 101 to the recording medium 108 is also not particularly limited, but is preferably equal to or more than a glass transition point or softening point of a resin component contained in the ink. Further, for heating, it is preferable to provide a heating device heating the second image on the transfer body 101, the transfer body 101, and the recording medium 108. A shape of the pressing member 106 is not particularly limited, but the pressing member 106 can have, for example, a roller shape.

<Recording Medium and Recording Medium Conveyance Device>

In the present exemplary embodiment, the recording medium 108 is not particularly limited, but any recording medium known in the art can be used. Examples of the recording medium 108 can include long media rolled in a roll shape or sheet media cut at a predetermined size. Materials thereof can include paper, plastic films, wood boards, corrugated cardboards, metal films, and the like.

Further, in FIG. 1, the recording medium conveyance device 107 for conveying the recording medium 108 is composed of a recording medium feeding roller 107*a* and a recording medium winding roller 107*b*, but may be composed of any members capable of conveying the recording medium 108, and is not specifically limited to this configuration.

<Control System>

Figure 2:
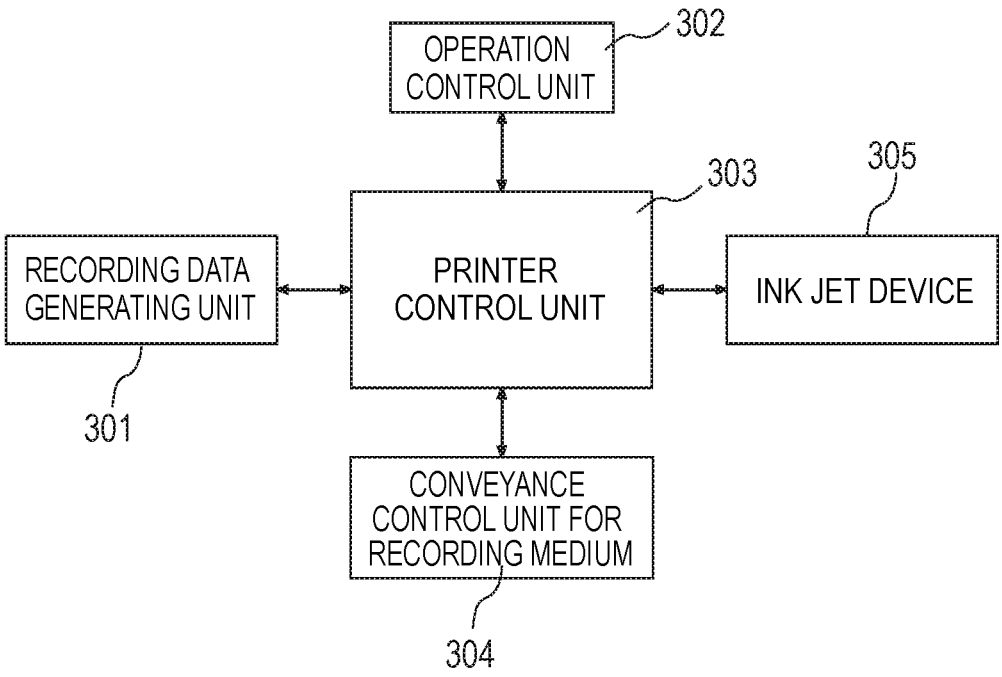
FIG. 2 is a block diagram illustrating a control system of the entire ink jet recording apparatus illustrated in FIG. 1.

The ink jet recording apparatus 100 according to the present exemplary embodiment has a control system for controlling each of the devices. FIG. 2 is a block diagram illustrating a control system of the entire ink jet recording apparatus 100 illustrated in FIG. 1. In FIG. 2, reference numeral 301 denotes a recording data generating unit such as an external print server or the like, reference numeral 302 denotes an operation control unit such as an operation panel, reference numeral 303 denotes a printer control unit for executing a recording process, reference numeral 304 denotes a conveyance control unit for a recording medium for conveying the recording medium, and reference numeral 305 denotes an ink jet device for printing.

Figure 3:
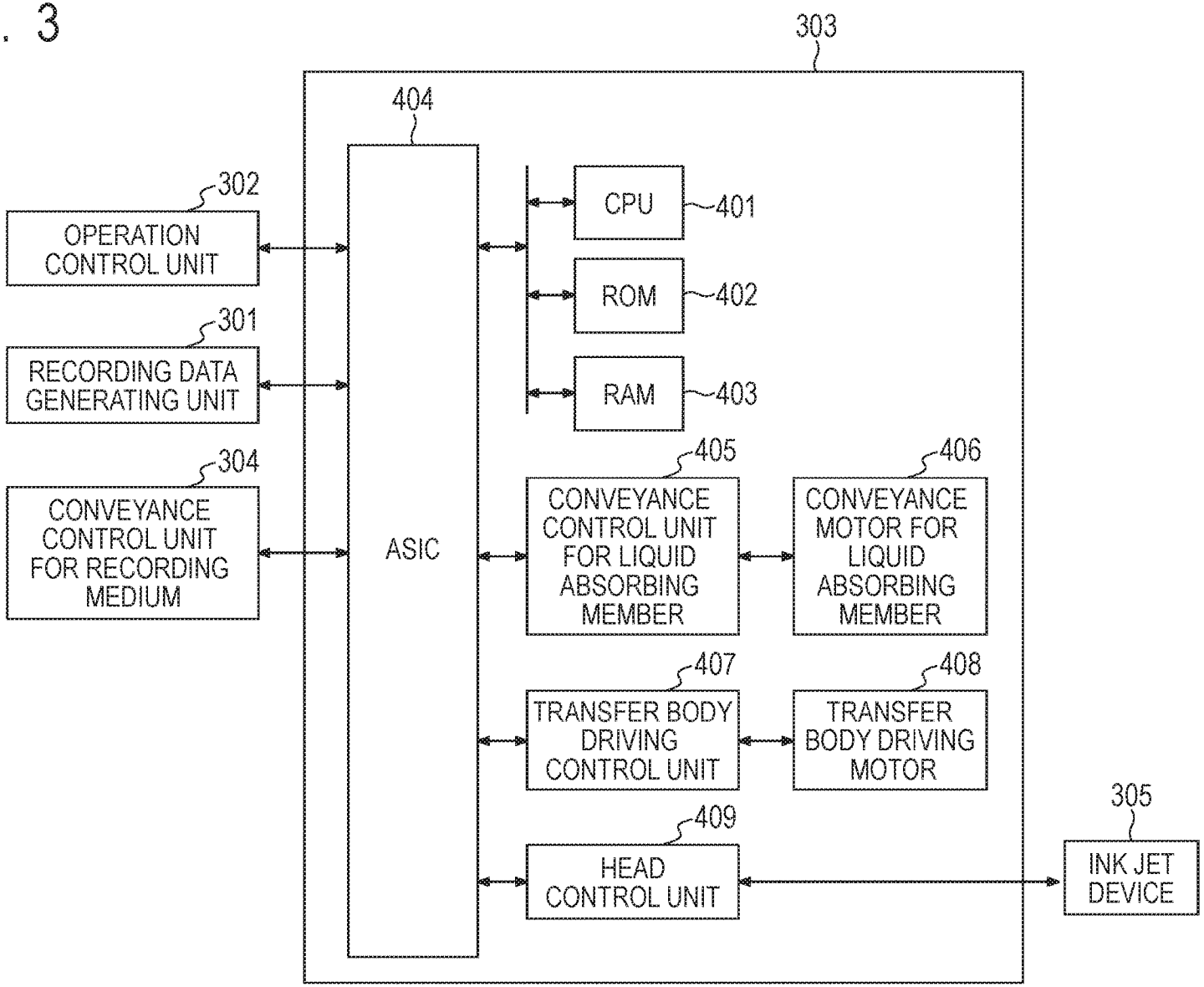
FIG. 3 is a block diagram of a printer control unit in the ink jet recording apparatus illustrated in FIG. 1.

FIG. 3 is a block diagram of the printer control unit in the ink jet recording apparatus 100 of FIG. 1. Reference numeral 401 denotes a CPU for controlling the entire printer, reference numeral 402 denotes a ROM for storing a control program of the CPU, and reference numeral 403 denotes a RAM for executing a program. Reference numeral 404 denotes an application specific integrated circuit (ASIC), including a network controller, a serial IF controller, a controller for generating head data, a motor controller, and the like. Reference numeral 405 denotes a conveyance control unit for a liquid absorbing member for driving a conveyance motor 406 for a liquid absorbing member, and the conveyance control unit 405 is controlled by a command from the ASIC 404 via a serial IF. Reference numeral 407 denotes a transfer body driving control unit for driving a transfer body driving motor 408, and the transfer body driving control unit 407 is also controlled by a command from the ASIC 404 via a serial IF. Reference numeral 409 denotes a head control unit, and the head control unit 409 generates final discharge data of the ink jet device 305 and generates a driving voltage and the like.

According to the present invention, it is possible to provide an ink jet recording apparatus capable of simultaneously suppressing coloring material from being adhered to a porous body and being re-transferred to a transfer body.

EXAMPLE

Hereinafter, the present invention is described in more detail through Examples and Comparative Examples. The present invention is not limited by the following Examples without departing from the gist of the present invention. Further, in the description of the following Examples, unless otherwise specified, the term "part" is based on mass.

<Preparation of Reaction Liquid>

As a reaction liquid, a reaction liquid having the following composition was used. Further, the balance of ion exchange water is an amount of the ion exchange water at which a total content of all the components constituting the reaction liquid was 100.0 mass %.

Glutaric acid: 21.0 mass %

Glycerin: 5.0 mass %

Surfactant (trade name: "Megaface F444", manufactured by DIC Corp.): 5.0 mass %

Ion exchange water: balance

<Preparation of Pigment Dispersion>

First, 10 parts of carbon black (trade name: "Monarch 1100", manufactured by Cabot Corporation), 15 parts of an aqueous solution of a resin (an aqueous solution containing a styrene-ethyl acrylate-acrylic acid copolymer (acid value: 150, weight average molecular weight (Mw): 8,000) and having a resin content of 20.0 mass % was neutralized with an aqueous solution of potassium hydroxide), and 75 parts of pure water were mixed with each other. After the mixture was placed in a batch type vertical sand mill (manufactured by AIMEX Co., Ltd.), 200 parts of zirconia beads having a diameter of 0.3 mm were added thereto, and the mixture was dispersed for 5 hours while cooling with water. Coarse particles were removed by centrifuging the dispersion, thereby obtaining a pigment dispersion in which a content of a pigment was 10.0 mass %.

<Preparation of Resin Fine Particle Dispersion>

After mixing 20 parts of ethyl methacrylate, 3 parts of 2,2'-azobis-(2-methybutyronitrile), and 2 parts of n-hexadecane with each other, the mixture was stirred for 0.5 hours. The mixture was dropped into 75 parts of an 8 mass % aqueous solution of a styrene-butyl acrylate-acrylic acid copolymer (acid value: 130 mgKOH/g, weight average molecular weight (Mw): 7,000), and stirred for 0.5 hours. Next, the resultant was irradiated with ultrasonic waves for 3 hours using an ultrasonic irradiator. Subsequently, a polymerization reaction was carried out at 80° C. for 4 hours under a nitrogen atmosphere, and the resultant was cooled to room temperature and filtered, thereby preparing a resin fine particle dispersion in which a content of a resin was 25.0 mass %.

<Preparation of Ink 1>

The pigment dispersion and the resin fine particle dispersion were mixed with the following respective components. Further, the "balance" of ion exchange water is an amount of the ion exchange water at which a total content of all the components constituting the ink 1 was 100.0 mass %.

Pigment dispersion: 40.0 mass %

Resin fine particle dispersion: 20.0 mass %

Glycerin: 7.0 mass %

Polyethylene glycol (number average molecular weight (Mn): 1,000): 3.0 mass %

Surfactant: "Acetylenol E100" (trade name, manufactured by Kawaken Fine Chemicals Co., Ltd.): 0.5 mass %

Ion exchange water: balance

These materials were sufficiently stirred and dispersed and then subjected to pressure-filtration using a micro filter having a pore size of 3.0 μm (manufactured by Fujifilm Corporation), thereby preparing ink 1.

<Manufacturing of Porous Body>

A porous body was manufactured using materials illustrated in Table 1. More specifically, the porous body was manufactured using the following method. As a first layer of the porous body coming in contact with a first image, a material illustrated in Table 1 was used. The porous body was manufactured by laminating first layer and non-woven fabric composed of polyethylene (PE) and polypropylene (PP) fiber by heat. In Table 1, as polytetrafluoroethylene (PTFE), a porous PTFE film formed by biaxial stretching was used. As polyamideimide (PAI), a porous PAI film formed by a phase separation method was used. As polypropylene (PP), a porous PP film formed by sintering fine particles was used.

<Manufacturing of Cleaning Member for Liquid Absorbing Member>

A cleaning member for a liquid absorbing member was manufactured using a material illustrated in Table 1. More specifically, the cleaning member was manufactured using the following method. The cleaning member was manufactured by forming a layer made of the material illustrated in Table 1 at a thickness of 10 mm on a core material made of SUS and having a diameter of 50 mm. In addition, when PTFE or PAI was used as the material illustrated in Table 1, the cleaning member was manufactured by winding a sheet made of the material and having a thickness of 50 μm on a core material made of SUS and having a diameter of 60 mm. In Table 1, as butyl rubber, a butyl rubber product manufactured by Katsura Roller Manufacturing Co., Ltd. was used. As for other rubber (NBR, SBR, EPDM, silicone rubber, and urethane rubber) products, rubber products manufactured by Kureha Elastomer Co., Ltd. was used. Further, in Table 1, "butyl" refers to butyl rubber, "silicone" refers to "silicone rubber", and "urethane" refers to "urethane rubber".

<Manufacturing of Transfer Body>

A transfer body was manufactured using a material illustrated in Table 1. For example, in the case of using a silicon compound (referred to as "Solgel" in Table 1) synthesized by a sol-gel method as the material, specifically, a transfer body was manufactured by the following method. A sheet in which a PET sheet having a thickness of 0.5 mm was coated with silicone rubber (trade name: "KE12", manufactured by Shin-Etsu Chemical Co., Ltd.) at a thickness of 0.3 mm was used as an elastic layer of a transfer body 101. Further, a mixture of a condensate obtained by mixing glycidoxypropyltriethoxysilane and methyltriethoxysilane with each other at a molar ratio of 1:1 and heating and refluxing them and a photo-cation polymerization initiator (trade name: "SP150", manufactured by ADEKA) was prepared. Atmospheric plasma treatment was performed so that a contact angle between a surface of the elastic layer and water was 10 degrees or less. Thereafter, the mixture was applied onto the elastic layer and subjected to UV light irradiation (high-pressure mercury lamp, integrated exposure amount: 5000 mJ/cm$^2$) and thermal curing (150° C., 2 hours) to form a film, thereby manufacturing a transfer body in which a surface layer having a thickness of 0.5 μm was formed on the elastic body. In addition, a surface roughness Ra of the transfer body using the silicon compound synthesized by the sol-gel method as the material of the surface layer was 0.5 μm. Further, a Shore hardness of the transfer body was 40.

In Table 1, in the case of using NBR2 or butyl rubber, a transfer body was manufactured by adhering a layer made of NBR2 or butyl rubber and having a thickness of 1 mm to a PET sheet having a thickness of 0.5 mm using a double-sided tape. In the case of using PTFE, a transfer body was manufactured by adhering a layer made of PTFE and having a thickness of 0.1 mm to a PET sheet having a thickness of 0.5 mm using a double-sided tape.

<Ink Jet Recording Apparatus and Image Formation>

A transfer type ink jet recording apparatus illustrated in FIG. 1 was used. As the transfer body 101, the transfer body manufactured by the above-mentioned method was used. The transfer body 101 was fixed to a surface of a support member 102 using a double-sided tape. A surface of the transfer body 101 was maintained at 60° C. by a heating unit (not illustrated).

An application amount of a reaction liquid applied by a reaction liquid applying device 103 was 1 g/m$^2$. An ink jet recording head discharging ink by an on-demand method using an electro-thermal transducer was used as an ink applying device 104. An application amount of the ink in forming an image was 20 g/m$^2$.

A liquid absorbing member 105*a* had a porous body at a side thereof coming in contact with a first image. A nip pressure between the transfer body 101 and the liquid absorbing member 105*a* was made to be 5 kgf/cm$^2$ on average by applying a pressure with a pressing member 105*b* for absorbing a liquid. In addition, the pressing member 105*b* had a diameter of 200 mm. A conveyance speed of the liquid absorbing member 105*a* was 0.8 m/s and was adjusted by extending rollers 105*c*, 105*d*, and 105*e* conveying the liquid absorbing member 105*a* while extending the liquid absorbing member 105*a* so as to be equal to a movement speed of the transfer body 101. As a cleaning member 105*f*, the cleaning member manufactured by the above-mentioned method was used. A nip pressure of the cleaning member 105*f* with the liquid absorbing member 105*a* was 9.8 N/cm$^2$ (1.0 kgf/cm$^2$) and a nip width thereof was 6 mm. Pure water was put into a third liquid storage unit 105*i* and pure water was applied to the porous body of the liquid absorbing member 105*a* by a liquid applying member 105*h* corresponding to a rubber roller. As a material of the rubber roller, nitrile rubber (NBR) was used. As a liquid removing member 105*j*, an air-blowing type liquid removing member was used. Air was blown from a nozzle of the liquid removing member 105*j* onto a surface of the liquid absorbing member 105*a* opposite to a contact surface thereof coming in contact with the first image, such that the liquid held by the porous body of the liquid absorbing member 105*a* was blown off. Therefore, the pure water applied by the liquid applying member 105*h* was partially removed.

Further, a recording medium 108 was conveyed by a recording medium feeding roller 107*a* and a recording medium winding roller 107*b* so as to have a speed equal to the movement speed of the transfer body 101. A conveyance speed of the recording medium 108 was set to 0.8 m/s. As the recording medium 108, "Aurora coat paper" (manufactured by Nippon Paper Industries Co., Ltd., basis weight: 104 g/m$^2$) was used.

<Measurement of $Y_1$, $Y_2$, $Y_3$, and $Y_d$>

Surface free energy of a solid can be obtained by measuring contact angles to a plurality of liquids of which surface free energy are known in advance. In Present Example, "DropMaster700" (trade name, manufactured by Kyowa Interface Science Co., Ltd.) was used to measure $Y_1$, $Y_2$, $Y_3$, and $Y_d$. In addition, surface free energy was calculated using a Kitasaki-Hata Equation from a contact angle to each of the liquids which was measured using a plurality of liquids (water, diiodomethane, formamide, n-hexadecane, and ethylene glycol) of which surface free energies were known in advance. Further, with respect to $Y_d$, a dispersion force component of the surface free energy was measured after printing the ink on the transfer body applied with the reaction liquid so that the ink covered 100% of the transfer body and after drying the printed ink. Since almost the same values of the dispersion force component of surface free energy were obtained on the surface of the first image after printing on the transfer body and on the surface thereof after transfer to EPDM, it was thought that there was no substantial difference between dispersion force components of the surface free energy in external and internal portions of the first image. Measurement values of $Y_1$ to $Y_3$ and $Y_d$ and values of $|Y_d-Y_3|$, $|Y_d-Y_1|$, and $|Y_d-Y_2|$ are illustrated in Table 1.

<Measurement of Surface Roughness Ra>

A surface roughness Ra was measured by the following method. The surface roughness was measured in a RPD mode with a 50× objective lens (CF IC EPI PLAN Apo 50×, manufactured by Nikon Corporation) using a "VK9710 laser microscope" (trade name, manufactured by Keyence Corporation). The obtained data was processed with a noise filter (median), and the cutoff λc was 0.08 μm, such that the surface roughness was calculated with a reference line length of 200 μm. Further, the surface roughness Ra was an arithmetic mean roughness. A surface roughness Ra of the cleaning members using butyl rubber, EPDM1, EPDM3, NBR1, NBR2, and SBR as the material was 1.0 μm. Further, a surface roughness Ra of the cleaning members using EPDM2 as the material was 0.5 μm.

Further, a surface roughness Ra of the transfer body using NBR2 as the material was 1.0 μm.

<Measurement of Shore Hardness>

A Shore hardness of the material was measured by the following method. The Shore hardness was measured by a durometer type A (Shore A) specified in JIS K6253. Shore hardnesses of butyl rubber, EPDM1, EPDM2, NBR1, NBR2, and SBR were 40. Further, a Shore hardness of EPDM3 was 20.

[Evaluation]

The ink jet recording apparatus in each of the Examples and Comparative Examples was evaluated by the following evaluation method. Evaluation results are illustrated in Table 2. In the present Example, as the evaluation criteria in the following evaluation items, "AA" to "B" were set as acceptable levels, and "C" was set as an unacceptable level.

<Coloring Material Adhesion>

In image formation, coloring material adhesion to the porous body after contacting the porous body with the first image was observed. Evaluation criteria were as follows.

A: Coloring material adhesion to the porous body was not observed.

B: Coloring material adhesion to the porous body was slightly observed, but was ignorable.

C: Coloring material adhesion to the porous body was frequently observed.

<Re-Transfer>

Re-transfer of the first image including the coloring material adhered to the porous body to the transfer body 101 in image formation was observed. Evaluation criteria were as follows.

AA: Coloring material adhesion to the transfer body 101 by re-transfer was not observed.

A: Coloring material adhesion to the transfer body 101 by re-transfer was slightly observed.

B: Coloring material adhesion to the transfer body 101 by re-transfer was observed but was ignorable.

C: Coloring material adhesion to the transfer body 101 by re-transfer was frequently observed.

TABLE 1

| | Ink | | Cleaning Member | | Transfer Body | | Porous Body | | | | |
|---|---|---|---|---|---|---|---|---|---|---|---|
| | Kind | $\gamma_d$ (mN/m) | Kind | $\gamma_3$ (mN/m) | Kind | $\gamma_1$ (mN/m) | Kind | $\gamma_2$ (mN/m) | $\lvert\gamma_d-\gamma_3\rvert$ | $\lvert\gamma_d-\gamma_1\rvert$ | $\lvert\gamma_d-\gamma_2\rvert$ |
| Example 1 | Ink 1 | 32 | Butyl | 27 | Solgel | 39 | PTFE | 18 | 5 | 7 | 14 |
| Example 2 | Ink 1 | 32 | Butyl | 27 | Solgel | 39 | PAI | 50 | 5 | 7 | 18 |
| Example 3 | Ink 1 | 32 | NBR1 | 28 | Solgel | 39 | PTFE | 18 | 4 | 7 | 14 |
| Example 4 | Ink 1 | 32 | NBR2 | 38 | Solgel | 39 | PTFE | 18 | 6 | 7 | 14 |
| Example 5 | Ink 1 | 32 | SBR | 33 | Solgel | 39 | PTFE | 18 | 1 | 7 | 14 |
| Example 6 | Ink 1 | 32 | EPDM1 | 28 | Solgel | 39 | PTFE | 18 | 4 | 7 | 14 |

TABLE 1-continued

| | Ink | | Cleaning Member | | Transfer Body | | Porous Body | | | | |
|---|---|---|---|---|---|---|---|---|---|---|---|
| | Kind | $\gamma_d$ (mN/m) | Kind | $\gamma_3$ (mN/m) | Kind | $\gamma_1$ (mN/m) | Kind | $\gamma_2$ (mN/m) | $\lvert\gamma_d - \gamma_3\rvert$ | $\lvert\gamma_d - \gamma_1\rvert$ | $\lvert\gamma_d - \gamma_2\rvert$ |
| Example 7 | Ink 1 | 32 | EPDM2 | 28 | Solgel | 39 | PTFE | 18 | 4 | 7 | 14 |
| Example 8 | Ink 1 | 32 | EPDM1 | 28 | NBR2 | 38 | PTFE | 18 | 4 | 6 | 14 |
| Example 9 | Ink 1 | 32 | EPDM3 | 28 | NBR2 | 38 | PTFE | 18 | 4 | 6 | 14 |
| Comparative Example 1 | Ink 1 | 32 | Butyl | 27 | Solgel | 39 | PP | 31 | 5 | 7 | 1 |
| Comparative Example 2 | Ink 1 | 32 | Butyl | 27 | PTFE | 18 | PTFE | 18 | 5 | 14 | 14 |
| Comparative Example 3 | Ink 1 | 32 | Silicone | 20 | Solgel | 39 | PTFE | 18 | 12 | 7 | 14 |
| Comparative Example 4 | Ink 1 | 32 | PTFE | 18 | Solgel | 39 | PTFE | 18 | 14 | 7 | 14 |
| Comparative Example 5 | Ink 1 | 32 | PAI | 50 | Solgel | 39 | PTFE | 18 | 18 | 7 | 14 |
| Comparative Example 6 | Ink 1 | 32 | Urethane | 43 | Solgel | 39 | PTFE | 18 | 11 | 7 | 14 |
| Comparative Example 7 | Ink 1 | 32 | Solgel | 39 | Solgel | 39 | PTFE | 18 | 7 | 7 | 14 |
| Comparative Example 8 | Ink 1 | 32 | Butyl | 27 | Butyl | 27 | PTFE | 18 | 5 | 5 | 14 |

TABLE 2

| | Evaluation Category | |
|---|---|---|
| | Coloring Material Adhesion | Re-transfer |
| Example 1 | A | A |
| Example 2 | B | A |
| Example 3 | A | A |
| Example 4 | A | B |
| Example 5 | A | B |
| Example 6 | A | AA |
| Example 7 | A | A |
| Example 8 | A | B |
| Example 9 | A | A |
| Comparative Example 1 | C | B |
| Comparative Example 2 | C | B |
| Comparative Example 3 | A | C |
| Comparative Example 4 | A | C |
| Comparative Example 5 | A | C |
| Comparative Example 6 | A | C |
| Comparative Example 7 | A | C |
| Comparative Example 8 | A | C |

As illustrated in Table 1, in Examples 1 to 9 satisfying $|Y_d-Y_3|<|Y_d-Y_1|<|Y_d-Y_2|$, coloring material adhesion and re-transfer were evaluated to be both preferable levels. Comparing Examples 1 and 2 with each other, in Example 1 in which $Y_d>Y_2$, coloring material adhesion was small than in Example 2 in which $Y_d<Y_2$. Further, comparing Examples 1, 3, and 6 with Examples 4 and 5, in Examples 1, 3, and 6 in which $Y_d>Y_3$, re-transfer was further suppressed than in Examples 4 and 5 in which $Y_d<Y_3$. Further, considering evaluations results of Examples 1, 3, 6, and 7 to 9 in addition to the above-mentioned evaluation results, it was confirmed that it was preferable to satisfy $Y_2<Y_3<Y_d<Y_1$.

Further, comparing Examples 6 and 7, the surface roughness Ra of the transfer body 101 was all 0.5 μm, whereas the surface roughness Ra of the cleaning member 105*f* was 1.0 μm in Example 6 and 0.5 μm in Example 7. It was confirmed that since re-transfer was further suppressed in Example 6 than in Example 7, it was preferable that the surface roughness Ra of the cleaning member 105*f* was larger than the surface roughness Ra of the transfer body 101.

Further, comparing Examples 8 and 9 with each other, the Shore hardness of NBR2 corresponding to the material constituting the transfer body 101 was 40, whereas the Shore hardness of the material constituting the cleaning member 105*f* was 40 in Example 8 (EPDM1) and 20 in Example 9 (EPDM3). It was confirmed that since re-transfer was further suppressed in Example 9 than in Example 8, it was preferable that the Shore hardness of the material constituting the transfer body 101 was higher than the Shore hardness of the material constituting the cleaning member 105*f*.

On the other hand, in Comparative Examples 1 and 2 in which $|Y_d-Y_1|\geq|Y_d-Y_2|$, coloring material adhesion to the porous body was frequent, such that an image defect occurred. Further, in Comparative Examples 3 to 8 in which $|Y_d-Y_3|\geq|Y_d-Y_1|$, it was confirmed that the first image remaining in the porous body after cleaning was re-transferred to the transfer body 101, such that an image defect occurred in a next process.

In addition, as described above, adhesion work $W_{ab}$ of the two substances is expressed by Equation, $W_{ab}=Y_d\ Y_b-Y_{ab}$. Here, comparing Examples 1 and 2 with each other, in Example 1 in which $Y_d>Y_2$, coloring material adhesion was smaller than in Example 2 in which $Y_d<Y_2$. Therefore, it is thought that a magnitude of a difference between $Y_a$ and $Y_b$ is more dominant over the adhesion work $W_{ab}$ than magnitudes of respective values of $Y_a$ and $Y_b$ in Equation. That is, it is estimated that as the closer the value to $Y_d$ among $Y_1$, $Y_2$, and $Y_3$, the smaller the interfacial free energy $Y_{ab}$ thereof, and as a result, the larger the adhesion work $W_{ab}$ (adhesive strength).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet recording apparatus comprising:

an image forming unit that forms a first image containing a first liquid and a coloring material on a transfer body; and a liquid absorbing device including a liquid absorbing member having a porous body coming in contact with the first image to at least partially absorb the first liquid from the first image, and a cleaning member coming in contact with the porous body to clean the porous body wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2| \quad (1).$$

2. The ink jet recording apparatus according to claim 1, wherein $Y_1$, $Y_2$, $Y_3$, and $Y_d$ satisfy the following Equation (2):

$$Y_2<Y_3<Y_d<Y_1 \quad (2).$$

3. The ink jet recording apparatus according to claim 1, wherein a Shore hardness of a material constituting the transfer body is higher than a Shore hardness of a material constituting the cleaning member.

4. The ink jet recording apparatus according to claim 1, wherein a surface roughness Ra of the cleaning member is larger than a surface roughness Ra of the transfer body.

5. The ink jet recording apparatus according to claim 1, wherein the liquid absorbing device further includes:

a liquid applying member that applies a third liquid onto the porous body; and a liquid removing member that partially removes the third liquid from the porous body applied with the third liquid.

6. The ink jet recording apparatus according to claim 1, wherein the image forming unit includes:

a device that applies a first liquid composition containing the first liquid or a second liquid and an ink viscosity-increasing component onto the transfer body; and a device that applies a second liquid composition containing the first liquid or second liquid and the coloring material onto the transfer body, and the first image is a mixture of the first and second liquid compositions and is more viscously thickened than the first and second liquid compositions.

7. The ink jet recording apparatus according to claim 1, further comprising a transfer device that transfers a second image obtained by at least partially absorbing the first liquid from the first image to a recording medium.

8. An ink jet recording method comprising the steps of:

forming a first image containing a first liquid and a coloring material on a transfer body;

contacting a porous body with the first image to at least partially absorb the first liquid from the first image; and contacting a cleaning member with the porous body to clean the porous body, wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2| \quad (1).$$

9. An ink jet recording apparatus comprising:

an image forming unit that applies ink containing a first liquid and a coloring material to form a first image on a transfer body; and a liquid absorbing device including a liquid absorbing member having a porous body coming in contact with the first image to concentrate the ink constituting the first image, and a cleaning member coming in contact with the porous body to clean the porous body, wherein surface free energy $Y_1$ of the transfer body, surface free energy $Y_2$ of the porous body, surface free energy $Y_3$ of the cleaning member, and a dispersion force component $Y_d$ of surface free energy of the first image satisfy the following Equation (1):

$$|Y_d-Y_3|<|Y_d-Y_1|<|Y_d-Y_2| \quad (1)$$

* * * * *